US005376944A

United States Patent [19]

Mogi et al.

[11] Patent Number: 5,376,944

[45] Date of Patent: Dec. 27, 1994

[54] LIQUID CRYSTAL DISPLAY DEVICE WITH SCANNING ELECTRODE SELECTION MEANS

[75] Inventors: Tomohiro Mogi, Tama; Minoru Usui, Akishima, both of Japan

[73] Assignee: Casio Computer Co., Ltd., Tokyo, Japan

[21] Appl. No.: 702,777

[22] Filed: May 17, 1991

[30] Foreign Application Priority Data

| | | | |
|---|---|---|---|
| May 25, 1990 | [JP] | Japan | 2-133911 |
| May 25, 1990 | [JP] | Japan | 2-133912 |
| Jun. 12, 1990 | [JP] | Japan | 2-151738 |
| Jun. 13, 1990 | [JP] | Japan | 2-152569 |
| Jun. 13, 1990 | [JP] | Japan | 2-152570 |

[51] Int. Cl.[5] ..... G09G 3/36

[52] U.S. Cl. ..... 345/100; 345/103

[58] Field of Search ..... 340/784 E, 784, 799, 340/767; 358/236, 58, 59, 241; 345/98, 94, 103, 97, 104, 100, 87, 103; 348/793, 792

[56] References Cited

U.S. PATENT DOCUMENTS

| | | | |
|---|---|---|---|
| 4,481,511 | 11/1984 | Hanmura et al. | 340/765 |
| 4,679,043 | 7/1987 | Morokawa | 345/103 |
| 4,745,485 | 5/1988 | Iwasaki | 340/784 E |
| 4,804,951 | 2/1989 | Yamashita et al. | 345/94 |
| 4,816,816 | 3/1989 | Usui | 345/103 |
| 4,845,473 | 7/1989 | Matsuhashi et al. | 340/765 |
| 4,944,578 | 7/1990 | Denison | 359/99 |
| 4,985,698 | 1/1991 | Mano et al. | 345/103 |
| 5,018,076 | 5/1991 | Johary et al. | 345/87 |
| 5,093,652 | 3/1992 | Bull et al. | 340/784 |

FOREIGN PATENT DOCUMENTS

| | | |
|---|---|---|
| 0291252 | 11/1988 | European Pat. Off. . |
| 0382567 | 8/1990 | European Pat. Off. . |
| 52-19960 | 5/1977 | Japan . |
| 52-23690 | 6/1977 | Japan . |
| 52-36372 | 9/1977 | Japan . |
| 53-42209 | 11/1978 | Japan . |

OTHER PUBLICATIONS

Patent Abstract of Japan, vol. 010, No. 224, Aug. 1986, Picture Display Device.

Patent Abstract of Japan, vol. 011, No. 178, Jun. 1987, Liquid Crystal Device.

*Primary Examiner*—Tommy P. Chin

*Assistant Examiner*—A. Au

*Attorney, Agent, or Firm*—Frishauf, Holtz, Goodman & Woodward

[57] ABSTRACT

In a liquid crystal display device, to improve the contrast, the frame frequency is raised by scanning the scanning electrodes of the liquid crystal display panel a plurality of times during one field interval of the video signal. The scanning electrodes are divided into two groups, which are scanned alternately. An image memory is provided to store video signals. In scanning the liquid crystal display panel, the video signal from the video signal supplying source and the video signal read from the image memory are alternately supplied to the liquid crystal display panel. The image memory stores only part of the video signal such as the video signal for every other horizontal scanning period or the signal consisting of the most significant bit only, not the entire video signal.

6 Claims, 15 Drawing Sheets

φH
EFFECTIVE VIDEO INTERVAL

E (3bit)

Ec (1bit)

SHIFT REGISTER
LSB
bit2
bit3
MSB

SELO

ST'

INH1

INH2

φn

X'1
X'2
X'3
X'4
X'119
X'120

X'121
X'122
X'123
X'238
X'239
X'240

φH
EFFECTIVE VIDEO INTERVAL

E (3bit)

EC (1bit)

SHIFT REGISTER

SEL0

SELECTED DATA

ST1

ST2

φn

INH1

INH2

(X'1)
X'2
X'3
X'4
X'119
X'120

X'121
X'122
X'123
X'238
X'239
(X'240)

FIG.12A φH
FIG.12B EA
FIG.12C EB
FIG.12D SEL
FIG.12E DAB
FIG.12F ST
FIG.12G INT1
FIG.12H INT2

EFFECTIVE VIDEO INTERVAL
VIDEO DATA E(n)

| $E_O$ | | | | $E_A$ | | | | $E_B$ | | | | $\frac{E_A+E_B}{2}$ |
|---|---|---|---|---|---|---|---|---|---|---|---|---|
| D3 | D2 | D1 | (dec.) | D2 | D1 | D3 | (dec.) | D3 | D3 | D3 | (dec.) | (dec.) |
| 0 | 0 | 0 | 0 | 0 | 0 | 0 | 0 | 0 | 0 | 0 | 0 | 0 |
| 0 | 0 | 1 | 1 | 0 | 1 | 0 | 2 | 0 | 0 | 0 | 0 | 1 |
| 0 | 1 | 0 | 2 | 1 | 0 | 0 | 4 | 0 | 0 | 0 | 0 | 2 |
| 0 | 1 | 1 | 3 | 1 | 1 | 0 | 6 | 0 | 0 | 0 | 0 | 3 |
| 1 | 0 | 0 | 4 | 0 | 0 | 1 | 1 | 1 | 1 | 1 | 7 | 4 |
| 1 | 0 | 1 | 5 | 0 | 1 | 1 | 3 | 1 | 1 | 1 | 7 | 5 |
| 1 | 1 | 0 | 6 | 1 | 0 | 1 | 5 | 1 | 1 | 1 | 7 | 6 |
| 1 | 1 | 1 | 7 | 1 | 1 | 1 | 7 | 1 | 1 | 1 | 7 | 7 |

FIG.16A φH
FIG.16B EA
FIG.16C EB
FIG.16D SEL
FIG.16E DAB
FIG.16F STO
FIG.16G INT1
FIG.16H INT2

EFFECTIVE VIDEO INTERVAL
VIDEO DATA E(n)

| E0 | | | | | E'A | | | | EA | EB | | | | |
|---|---|---|---|---|---|---|---|---|---|---|---|---|---|---|
| D3 | D2 | D1 | D0 | | D2 | D1 | D3 | =a | a+D0=a' | D3 | D3 | D3 | =b | a'+b |
| 0 | 0 | 0 | 0 | (0) | 0 | 0 | 0 | (0) | (0) | 0 | 0 | 0 | (0) | 0 |
| 0 | 0 | 0 | 1 | (1) | 0 | 0 | 0 | (0) | (1) | 0 | 0 | 0 | (0) | 1 |
| 0 | 0 | 1 | 0 | (2) | 0 | 1 | 0 | (2) | (2) | 0 | 0 | 0 | (0) | 2 |
| 0 | 0 | 1 | 1 | (3) | 0 | 1 | 0 | (2) | (3) | 0 | 0 | 0 | (0) | 3 |
| 0 | 1 | 0 | 0 | (4) | 1 | 0 | 0 | (4) | (4) | 0 | 0 | 0 | (0) | 4 |
| 0 | 1 | 0 | 1 | (5) | 1 | 0 | 0 | (4) | (5) | 0 | 0 | 0 | (0) | 5 |
| 0 | 1 | 1 | 0 | (6) | 1 | 1 | 0 | (6) | (6) | 0 | 0 | 0 | (0) | 6 |
| 0 | 1 | 1 | 1 | (7) | 1 | 1 | 0 | (6) | (7) | 0 | 0 | 0 | (0) | 7 |
| 1 | 0 | 0 | 0 | (8) | 0 | 0 | 1 | (1) | (1) | 1 | 1 | 1 | (7) | 8 |
| 1 | 0 | 0 | 1 | (9) | 0 | 0 | 1 | (1) | (2) | 1 | 1 | 1 | (7) | 9 |
| 1 | 0 | 1 | 0 | (10) | 0 | 1 | 1 | (3) | (3) | 1 | 1 | 1 | (7) | 10 |
| 1 | 0 | 1 | 1 | (11) | 0 | 1 | 1 | (3) | (4) | 1 | 1 | 1 | (7) | 11 |
| 1 | 1 | 0 | 0 | (12) | 1 | 0 | 1 | (5) | (5) | 1 | 1 | 1 | (7) | 12 |
| 1 | 1 | 0 | 1 | (13) | 1 | 0 | 1 | (5) | (6) | 1 | 1 | 1 | (7) | 13 |
| 1 | 1 | 1 | 0 | (14) | 1 | 1 | 1 | (7) | (7) | 1 | 1 | 1 | (7) | 14 |
| 1 | 1 | 1 | 1 | (15) | 1 | 1 | 1 | (7) | (7) | 1 | 1 | 1 | (7) | 14 |

LIQUID CRYSTAL DISPLAY DEVICE WITH SCANNING ELECTRODE SELECTION MEANS

BACKGROUND OF THE INVENTION

1. Field of the Invention

This invention relates to a liquid crystal display device, and more particularly to a liquid crystal display device with a relatively large screen for use in liquid crystal television sets, liquid crystal projectors, personal computers and the like.

2. Description of the Related Art

Getting larger in size, recent liquid crystal display panels have found their applications as a display in liquid crystal television sets or liquid crystal projectors. For the operation mode, such liquid crystal display panels often use the STN mode because of the high contrast, rather than the TN mode conventionally in common use.

It is well known that as the number of scanning lines increases due to larger panel sizes, the liquid crystal contrast decreases.

One method to avoid this problem, as disclosed in Published Examined Japanese Patent Application No. 52-199960, is that the select time for each scanning electrode is doubled by dividing the signal electrodes of the liquid crystal display panel into two groups, upper and the lower groups, and making a parallel drive of each group.

With this technique, the voltage margin in driving the liquid crystal can be increased and the contrast can be raised. Theoretically, the larger the number of divisions, the higher the contrast. From a manufacturing viewpoint, however, the maximum number of divisions is two, preventing further improvements in the contrast.

SUMMARY OF THE INVENTION

Accordingly, the object of the present invention is to provide a liquid-crystal display device capable of achieving high contrast without increasing the number of groups into which the liquid-crystal display panel is divided, even if the panel is a relatively large liquid crystal display panel with many scanning lines.

The forgoing object is accomplished by a liquid crystal display device, comprising: image-displaying liquid crystal display panel means having a plurality of scanning electrodes and a plurality of signal electrodes, the plurality of scanning electrodes being divided into a plurality of groups; a video signal source outputting a video signal; memory means for storing the video signal from the video signal source; selecting means for alternately selecting the video signal from the video signal source and the video signal read from the memory means and then outputting the selected signal; scanning means for selecting the groups of scanning electrodes of the liquid crystal display panel means in turns and then scanning the scanning electrodes a plurality of times during one field interval; timing signal generating means for supplying the scanning timing signal to the scanning means; and signal electrode driving means for receiving the video signal from the selecting means and then driving the signal electrodes of the liquid crystal display panel means by-using the video signal corresponding to the scanning electrodes being scanned by the scanning means.

With this arrangement, the frame frequency of liquid crystal driving is increased, thereby improving the display contrast. Particularly, the STN liquid crystal presents a remarkable effect. To cope with the need for more memory, storing only part of the video data in the memory prevents the memory capacity from increasing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 12A through 12J are time charts for explaining the operation of the fourth embodiment;

FIGS. 16A through 16J are time charts for explaining the operation of the fifth embodiment;

DETAILED DESCRIPTION OF THE PREFERRED EMBODIMENTS

A liquid crystal display device according to a first embodiment of the present invention will be explained referring to the accompanying drawings.

The liquid crystal display according to the first embodiment comprises: a memory with a capacity of one-half the number of fields times the number of data bits for storing a series of video data during every other horizontal interval; a select circuit for alternately outputting the video data stored in the memory and the video data bypassing the memory during every horizontal interval; a signal electrode driving circuit for driving the signal electrodes on the basis of the video signals from the select circuit; and a scanning electrode driving circuit for driving the scanning electrodes corresponding to the video data in groups of multiple electrodes. In this arrangement, the signal electrodes are driven by being alternately supplied with the video data stored in the memory and the fresh video data bypassing the memory, either video data being supplied during one horizontal scanning period. At the same time, two scanning electrodes corresponding to the video data are driven.

This embodiment will now be explained in detail.

Figure 1:
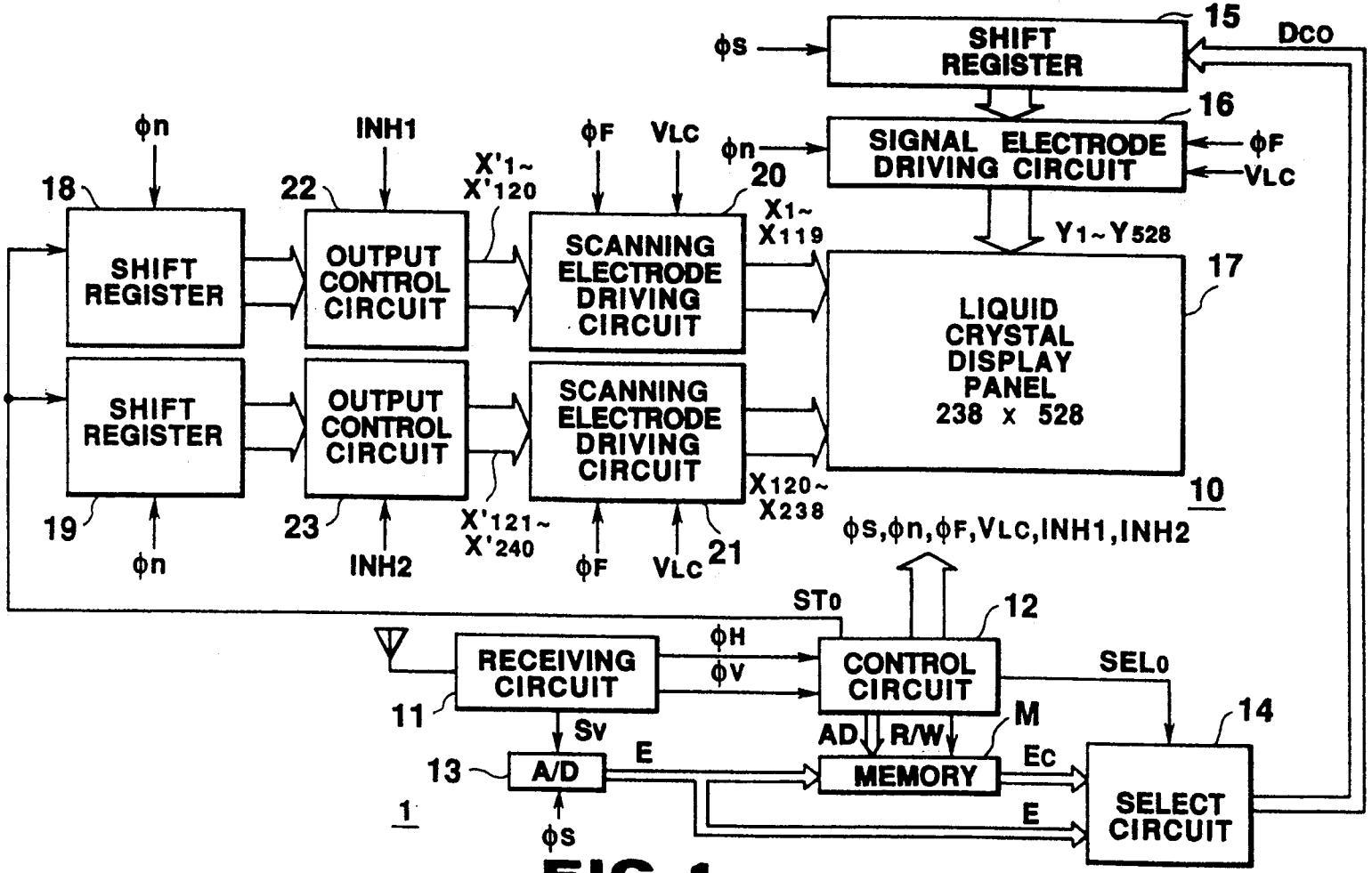
FIG. 1 is a block diagram for a first embodiment of the present invention.

In the embodiment, a liquid crystal display device according to the present invention is applied to a liquid crystal television. FIG. 1 is a block diagram of the liquid crystal television and FIGS. 2A through 2J are time charts representing the operation of the device in FIG. 1.

In FIG. 1, numeral 1 indicates a television circuit section and 10 a liquid crystal display section. The television circuit section 1 contains a receiving circuit 11, which includes a tuner, an intermediate frequency circuit, a detecting circuit, a chrominance signal reproducing circuit, and a sound circuit. The receiving circuit 11 extracts the video signal SV containing the R (red), G (green), and B (blue) video signals from the received television signal to supply it to an A/D conversion circuit 13. It also extracts the horizontal synchronizing signal $\phi$H and the vertical synchronizing signal $\phi$V to supply them to a control circuit 12. It further extracts the sound signal, which with other signals related to the sound system are omitted here.

Synchronizing with the horizontal synchronizing signal $\phi$H and vertical synchronizing signal $\phi$V, the control circuit 12 produces various timing signals for controlling the timing of the entire system operation, including: the start signal ST0, clock signal $\phi$S, latch signal $\phi$n, inversion signal $\phi$F, output inhibit signals INH1 and INH2, select signal SEL0, address signal AD, and read/write signal R/W. It also outputs the liquid crystal driving voltages VLC. The A/D converter circuit 13 converts the video signal Sv containing the R, G, and B video signals from an analog into a digital form, with the result that each of the R, G, and B video signals is converted into a digital video data of k bits, for example, three bits. The A/D converter circuit 13 performs A/D conversion of the R, G, and B video signals at a different timing to supply these three A/D-converted video data as time-sharing 3-bit video data E. The video data E is supplied to a memory M and a select circuit 14. The memory M is a video memory with a capacity of ½ field for storing a series of video data during every other horizontal interval within the one-field period, whose addressing and read/write operation are controlled by the control circuit 12. The select circuit 14 selects either the video data EC from the memory M or the video data directly supplied from the A/D converter circuit 13 depending on the select signal SEL0 from the control circuit 12, and then supplies the selected data as data DC0 to the liquid crystal display section 10.

The liquid crystal display section 10 contains: a liquid crystal display panel 17; a shift register 15 for receiving data DC0 in a serial manner, storing a single scanning line of data DC0, and outputting it in a parallel manner; and a signal electrode driving circuit 16 for selecting specified liquid crystal driving voltages according to the data from the shift register 15 and applying them to the signal electrodes Y1 through Y528.

To scan the liquid crystal display panel 17, shift registers 18 and 19 shift the start signal ST0 from the control circuit 12 successively and supply the resulting signal to scanning electrode driving circuits 20 and 21 via output control circuits 22 and 23. The output control circuits 22 and 23 prevent part of the signal from being supplied on the basis of the inhibit signals INH1 and INH2 from the control circuit 12. The scanning electrode driving circuits 20 and 21 select a specified liquid crystal driving voltage according to the signal from the output control circuits 22 and 23, and apply the voltage to the scanning electrode of the liquid crystal display panel 17. The scanning electrode driving circuit 20 actuates scanning electrodes X1 through X119, while the scanning electrode driving circuit 21 actuates scanning electrodes X120 through X238.

The start signal ST0 generated by the control circuit, which determines the start timing to scan the liquid crystal display panel 17, is supplied to the shift registers 18 and 19. The clock signal $\phi$S acts as the sampling clock for the A/D converter circuit 13 and as the basic clock for operating the logic circuit constituting each circuit. The latch signal $\phi$n is supplied to the shift registers 18 and 19 as a shift signal for shifting the start signal ST0 or a scanning timing signal for the liquid crystal display panel 17. It is also supplied to the signal electrode driving circuit 16 as a latch signal for latching a single line of data. The inversion signal $\phi$F is used to invert the voltage (VLC) applied to the scanning electrodes or signal electrodes at specified periods, for example, at single-frame or two-field periods to drive the liquid crystal by the alternating signal. The output inhibit signals INH1 and INH2 are supplied to the output control circuits 22 and 23 to inhibit part of the output from being supplied. The select signal SEL0 is used to select one of two inputs at the select circuit 14. The address signal AD is for specifying an address in the memory M, whereas the read/write signal R/W is for specifying read/write operation for the memory M. The control circuit 12 generates these timing signals at the timing shown in FIG. 2.

The liquid crystal display panel 17 is of the STN type, where 238 scanning electrodes X1 through X238 and 528 signal electrodes Y1 through Y528 are arranged. Corresponding to the signal electrodes, RGB color filters are provided.

Figure 3:
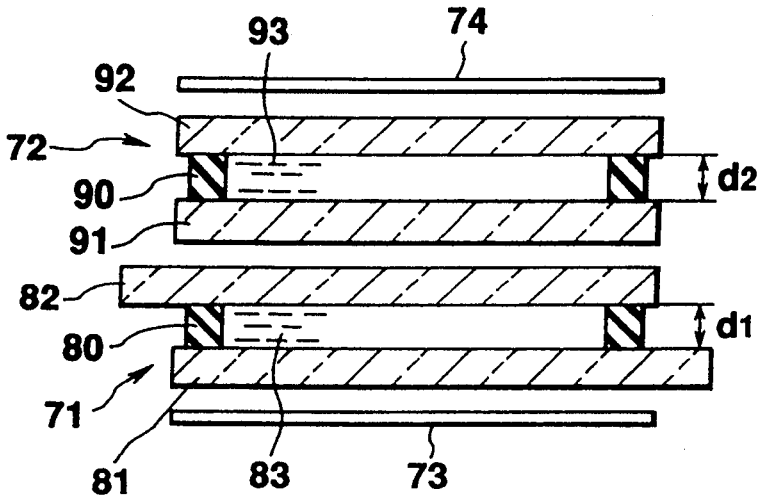
FIG. 3 is a view showing the construction of a liquid-crystal display panel according to the first embodiment.

FIG. 3 shows a sectional view of the liquid crystal display panel 17 composed of two-layer STN liquid crystal display elements with a color compensation liquid crystal cell 72 being arranged on the light-outgoing side of a display liquid crystal cell 71.

The two-layer STN liquid crystal display element has two STN liquid crystal cells stacked one over the other and polarizing plates 73 and 74 on both surfaces of the cell-stacked body. In FIG. 3, the lower (light-incoming side) liquid crystal cell 71 is for display and the upper (light-outgoing side) liquid crystal cell 72 is for color compensation. Hereinafter, the display liquid crystal cell 71 is referred to as the display cell and the color compensation liquid crystal cell 72 as the compensation cell.

The display cell 71 includes liquid crystal 83 sealed between a pair of transparent substrates 81 and 82 by means of a frame-shaped sealant 80. On the surfaces facing each other of both substrates 81 and 82, display transparent electrodes (scanning electrode and signal electrode) are formed, on which orientation treatment is carried out. The compensation cell 72 includes liquid crystal 93 sealed between a pair of transparent substrates 91 and 92 by means of a frame-shaped sealant 90. On the surfaces facing each other of both substrates 91 and 92 without any display electrodes on them, only orientation treatment is performed. The orientation treatment is such that the surface of a horizontal orientation film made from polyimide or the like is rubbed.

Figure 4:
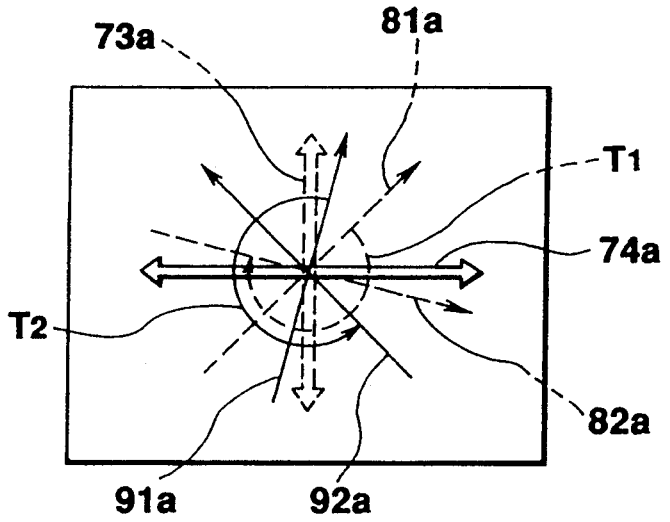
FIG. 4 is a view illustrating the orientation of liquid crystal molecules and the direction of the polarization axis of the polarizing plate in the liquid-crystal display panel according to the first embodiment.

FIG. 4 is a view illustrating the orientation direction of liquid crystal molecules in the display cell 71 and compensation cell 72 and the direction of the polarization axis of the polarizing plates 73 and 74. Here, numerals 81*a* and 82*a* indicate the direction of orientation treatment for the surfaces of the lower substrate 81 and the upper substrate 82 of the display cell 71, respectively. T1 indicates the direction of twist in the liquid crystal molecular arrangement. The liquid crystal 83 of the display cell 71 is made of nematic liquid crystal mixed with an optically active substance with left-handed rotatory power (e.g., chiral liquid crystal) to provide left-handed optical rotatory power. Molecules in the liquid crystal 83 between the substrates 81 and 82 are twisted counterclockwise, when viewed from the traveling direction of the transmitted light (viewed from the lower substrate 82), at a twist angle equivalent to the angle (240° in the figure) between the directions of orientation treatment 81*a* and 82*a*. Numerals 91*a* and 92*a* indicate the direction of orientation treatment for the surfaces of the lower substrate 91 and the upper substrate 92 in the compensation cell 72. T2 indicates the direction of twist in the liquid crystal molecular arrangement. The direction 91*a* of orientation treatment for the surface of the lower substrate 91 is almost at right angles to the direction 92*a* of orientation treatment for the surface of the upper substrate 92 in the display cell 71. The liquid crystal 93 of the compensation cell 72 is made of nematic liquid crystal mixed with an optically active substance with right-handed rotatory power (e.g., chiral liquid crystal) to provide right-handed optical rotatory power. Molecules in the liquid crystal 93 between the substrates 91 and 92 are twisted clockwise, when viewed from the traveling direction of the transmitted light, at a twist angle equal to the twist angle (240° in the figure) in the display cell 71. 73*a* and 74*a* indicate the direction of the polarizing axis for a pair of polarizing plates 73 and 74, respectively. The direction 74*a* of polarizing axis of the upper polarizing plate 74 deviates clockwise at an angle of 35° to 50° from the orientation treatment direction 92*a* of the upper substrate 92 in the compensation cell 72, when viewed from the traveling direction of the transmitted light. The direction 73*a* of polarizing axis of the lower polarizing plate 73 lies almost at right angles to the polarizing axis direction 74*a* of the upper polarizing plate 74. Nematic liquid crystal 83 and 93 used in the display cell 71 and compensation cell 72 essentially consists of the same liquid crystal, except that the properties of the optically active substance mixed differs. The thicknesses (cell gaps) d1 and d2 of the liquid crystal layer in the display cell 71 and compensation cell 72 are the same or d2 is a little smaller than d1.

Therefore, when the liquid crystal molecules in the display cell 71 and compensation cell 72 are arranged in a twisted manner in opposite directions at an equal angle to each other, with orientation treatment directions 82*a* and 81*a* of the display cell 71's upper substrate 82 and compensation cell 72's lower substrate 91 almost at right angles, the axis of the ellipse for elliptically polarized light for each wavelength generated by optically rotatory dispersion in the liquid crystal layers of the display cell 71 and compensation cell 72 almost coincides with each other. Consequently, coloring in display due to leakage of light in a specific wavelength range can be eliminated. That is, coloring of STN liquid crystal display elements in the display cell 71 can be eliminated by the compensation cell 72.

The operation of the embodiment will now be explained.

Figures 2A, 2B, 2C, 2D, 2E, 2F, 2G, 2H, 2I, 2J:
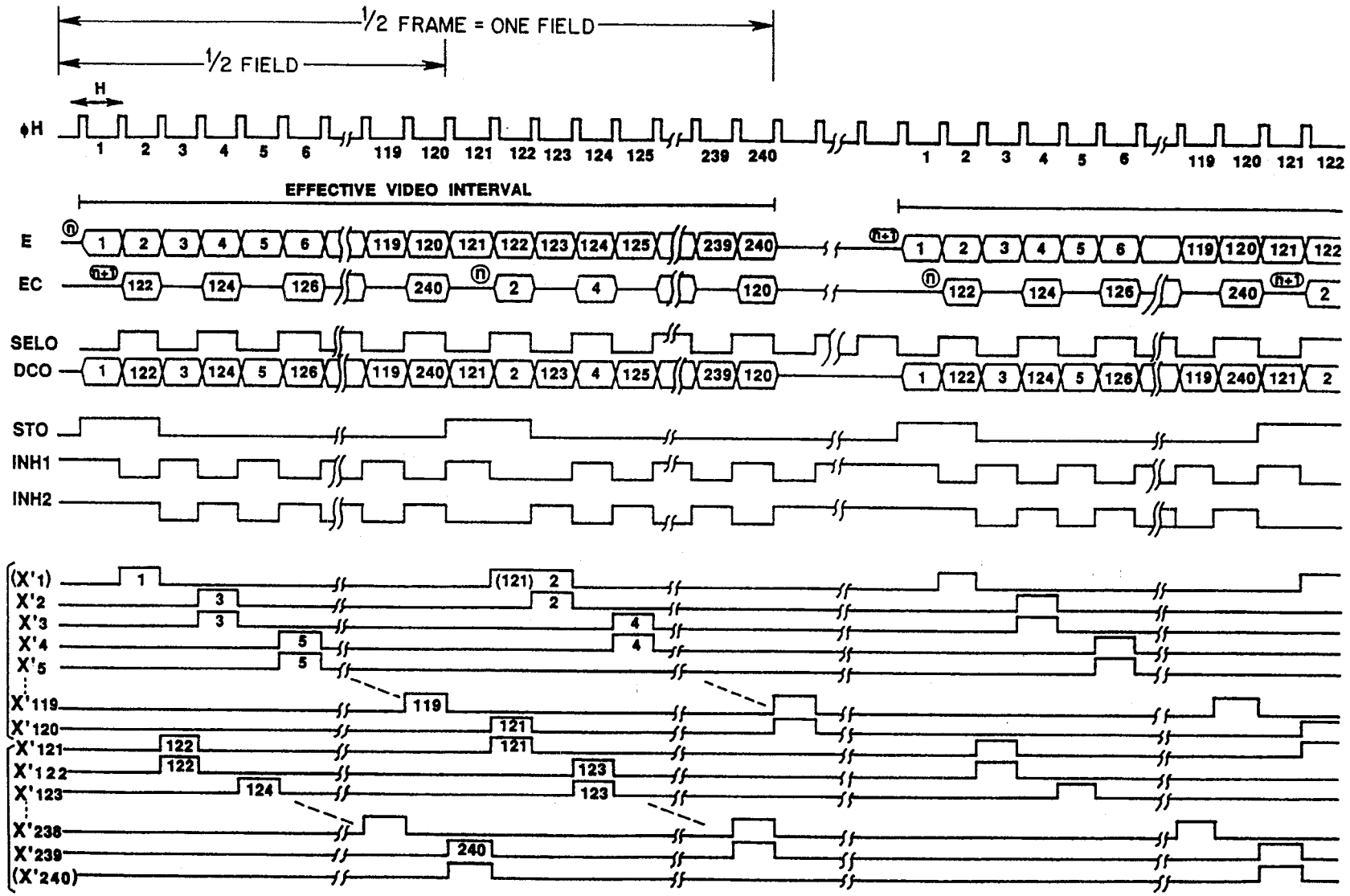
FIGS. 2A through 2J are time charts for explaining the operation of the first embodiment.

The receiving circuit 11 extracts from the received television signal the video signal SV, the horizontal synchronizing signal $\phi$H of FIG. 2A and the vertical synchronizing signal $\phi$v, and then supplies the video signal SV to the A/D converter 13 and the horizontal synchronizing signal $\phi$H and vertical synchronizing signal $\phi$V to the control circuit 12. Based on the horizontal synchronizing signal $\phi$H and vertical synchronizing signal $\phi$V, the control circuit 12 produces various timing signals including: the start signal ST0 of FIG. 2F, the clock signal $\phi$s, the latch signal $\phi$n, the inversion signal $\phi$F, the output inhibit signals INH1 and INH2 of FIGS. 2G and 2H, the select signal SEL0 of FIG. 2D, the address signal AD, and the read/write signal R/W. It then supplies these timing signals to the appropriate circuits including: the shift registers 15, 18, and 19, the driving circuits 16, 20, and 21, the select circuit 14, the memory M, the output control circuits 22 and 23, and the A/D converter 13. It also generates a plurality of liquid crystal driving voltages VLC to supply them to the driving circuits 16, 20, and 21.

The A/D converter 13 converts the received video signal SV into 3-bit digital video data E of FIG. 2B to supply it to the memory M. In FIG. 2B, n−1, n, n+1 indicate the numbers of the vertical scanning periods and 1 through 240 represent the numbers of the horizontal scanning periods. The same holds true for FIGS. 2C and 2F. The memory M reads the video data E during every other horizontal scanning period (1H) according to the address signal AD and the read/write signal R/W from the control circuit 12.

Then, after ½ field interval elapses from storage, the video data stored in the memory M is read on the basis of the address signal AD and read/write signal R/W from the control circuit 12, and is then supplied to the select circuit 14 as the video data EC of FIG. 2C. Based on the select signal SEL0 (FIG. 2D) from the control circuit 12, the select circuit 14 alternately supplies the video data E (FIG. 2B) from the A/D converter 13 and the video data EC (FIG. 2C) from the memory M. As a result, the output data DC0 from the select circuit 14 is arranged as shown in FIG. 2E. The output data DC0 is supplied to the shift register 15, which receives, shifts, and stores the data DC0 in synchronization with the clock signal $\phi$S from the control circuit 12. The data DC0 stored in the shift register 15 is supplied to the signal electrode driving circuit 16. In response to the latch signal $\phi$n from the control circuit 12, the signal electrode driving circuit 16 latches the output data from the shift register 15 for every elapsed horizontal scanning period. The driving circuit 16 converts the latched data into corresponding voltages among the liquid crystal driving voltages VLC supplied from the control circuit 12. The signal electrode driving circuit 16 inverts the polarity of the liquid crystal signals VCL in response to the inversion signal $\phi$F to drive the signal electrodes Y1 to Y528 with an alternating current. The signal electrode driving circuit 16 supplies the resulting liquid crystal driving voltages VLC to the segment electrodes of the liquid crystal display panel 7.

The start signal ST0 from the control circuit 12 goes high for two horizontal scanning periods for each ½ field as shown in FIG. 2F. This start signal ST0 is supplied to the shift registers 18 and 19 and in response to the clock signal $\phi$n, is shifted successively every one horizontal scanning period. As a result, each output signal from the shift registers 18 and 19 is such that consecutive two bits turn into "1" and other bits are "0". (This rule can be collapsed at the beginning and the end of a ½ frame, depending on the timing for latching the start signal ST0). Based on the output inhibit signals INH1 and INH2 (FIGS. 2G and 2H) that are inverted at every one horizontal scanning period in synchronism with the horizontal synchronizing signal $\phi$H, the output control circuits 22 and 23 supply to the scanning electrode driving circuits 20 and 21 the output signals from the shift registers 18 and 19 in the form of driving signals X'1 through X'120 and X'121 through X'240 Of FIGS. 2I and 2J. Reference characters at signal waveforms in FIGS. 2I and 2J indicate the numbers of the scanning lines which are driven in the timing. The scanning electrode driving circuits 20 and 21 convert the signals X'1 through X'120 and X'121 through x'240 into corresponding liquid crystal driving voltages VLC, while they perform the inversion of polarity in response to the inversion signal $\phi$F so that the liquid crystal display panel 17 is driven alternately. The driving circuits 20 and 21 apply the resulting liquid crystal driving voltages VLC to the scanning electrodes X1 through X119, and X120 through X238 of the liquid crystal display panel 17. This causes the scanning electrodes to be driven with alternating current in groups of two.

The output signals X'1 and X'240 are not used and only signals X'2 through X'239 are supplied to the 238 scanning electrodes for display. Consequently, the output signals X'2, X'3, . . . , X'120 correspond to the scanning electrodes X1, X2, . . . , X119, and the output signals X'121, X'122, . . . X'239 correspond to the scanning electrodes X120, X121, . . . , X238.

In this embodiment, the video data stored in the memory and the fresh video data bypassing the memory are alternately supplied to the signal electrodes, either video data being supplied during one horizontal scanning period. At the same time, the scanning electrodes corresponding to the video data are driven in groups of two. However, this invention is not restricted to this. For instance, the video data may be stored in a memory with a capacity of 1/a (a is an integer) field x the number of bits during every other (a−1) horizontal scanning period to drive the scanning electrodes corresponding to the video data in groups of a.

As described above, in the above embodiment, the video data stored in the memory and the fresh video data are supplied to the scanning electrodes, either video data being supplied during one horizontal scanning period. At the same time, the scanning electrodes corresponding to the video data are driven in groups of two. Thus, it is possible to provide a liquid crystal driving device with a smaller memory capacity that doubles the driving frequency without increasing the data transfer speed in the signal electrode driving circuit.

A second embodiment of the present invention will be explained hereinafter.

A liquid crystal display device according to a second embodiment of the present invention comprises: a memory section with a capacity of a ½ field x one bit for storing the video data containing at least the most significant bits of a series of video data; a select circuit for alternately outputting the video data stored in the memory section and the video data bypassing the memory section during every ½ horizontal scanning period; a signal electrode driving circuit for driving the signal electrodes on the basis of the video data from the select circuit; and a scanning electrode driving circuit for driving the scanning electrodes corresponding to the video data from the select circuit in groups of multiple electrodes. In this arrangement, the video data of the most significant bits stored in the memory section and the fresh data bypassing the memory are supplied to the scanning electrodes, either video data being supplied during ½ horizontal scanning period. At the same time, the scanning electrodes corresponding to the output data are driven.

Referring to the drawings, the second embodiment of the present invention will now be described in detail.

Figure 5:
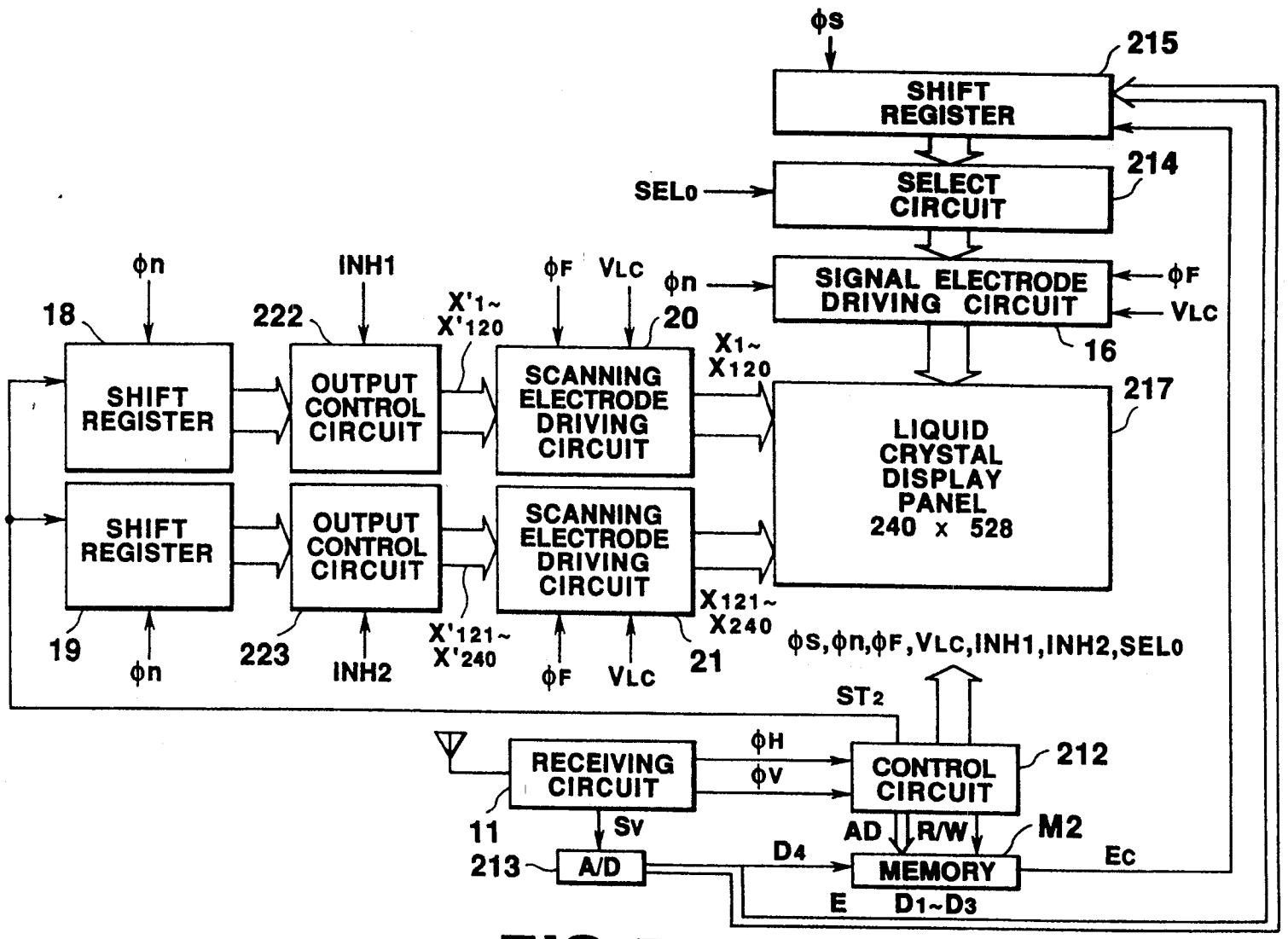
FIG. 5 is a block diagram for a second embodiment of the present invention.

FIG. 5 is a block diagram for a liquid crystal display device according to the second embodiment and FIGS. 6A through 6L are timing charts for illustrating the operation of the liquid crystal display device of FIG. 5 together with the contents of data. In this embodiment and subsequent embodiments, the same parts as those in the first embodiment are indicated by the same reference characters for clarity and their explanation will be simplified.

Figures 6A, 6B, 6C, 6D, 6E, 6F, 6G, 6H, 6I, 6J, 6K, 6L:
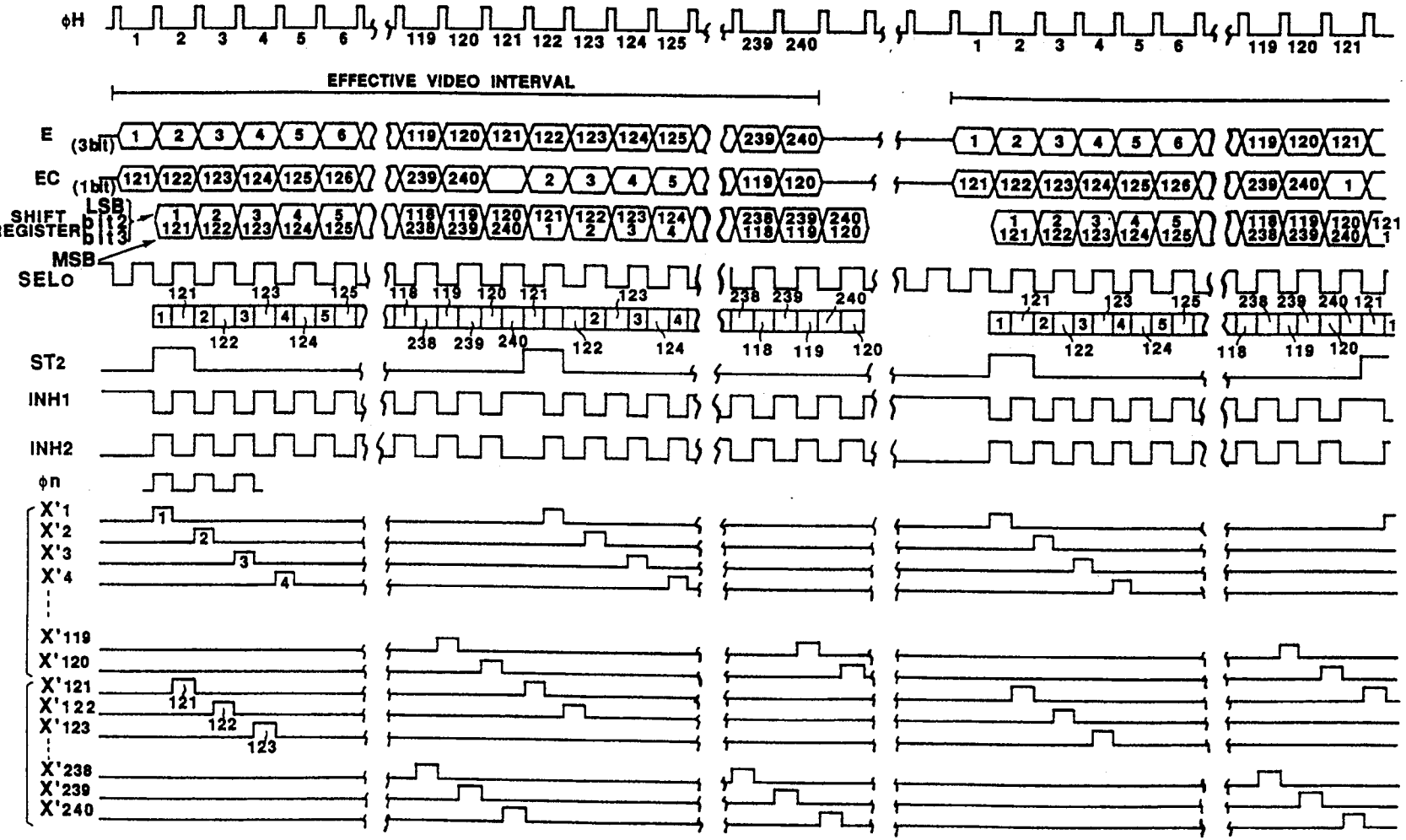
FIGS. 6A through 6L are time charts for explaining the operation of the second embodiment.

The receiving circuit 11 extracts from the received television signal the video signal SV, the horizontal synchronizing signal $\phi$H of FIG. 6A and the vertical synchronizing signal $\phi$V, and then supplies the video signal SV to the A/D converter 213 and the horizontal synchronizing signal $\phi$H and vertical synchronizing signal $\phi$V to the control circuit 212. Based on the horizontal synchronizing signal $\phi$H (FIG. 6A) and the vertical synchronizing signal $\phi$V, the control circuit 212 produces various timing signals including: the start 10 signal ST2 of FIG. 6G, the clock signal $\phi$s, the latch signal $\phi$n of FIG. 6J, the inversion signal $\phi$F, the output inhibit signals INH1 and INH2 of FIGS. 6H and 6I, the select signal SEL0 of FIG. 6E, the address signal AD, and the read/write signal R/W. It then supplies these timing signals to the appropriate circuits including: the shift registers 215, 18, and 19, the driving circuits 16, 20, and 21, the select circuit 214, the memory M2, the output control circuits 222 and 223. It also generates a plurality of liquid crystal driving voltages VLC to supply them to the driving circuit 16, 20, and 21.

The A/D converter 213 converts the received video signal SV into k-bit video data, for example, 4bit video data (D1 through D4) to supply it to the memory M2. The memory M2 reads the most significant bit (D4) of the video data according to the address signal AD and the read/write signal R/W from the control circuit 212.

A ½ field of data stored in the memory M2 is read on the basis of the address signal AD and read/write signal R/W from the control circuit 212 after a ½ field period elapses and then supplied as a 1-bit data EC to the shift register 215. FIGS. 6B and 6C show the timing relationship between the 3-bit video data E (D1 through D3)

from the A/D converter 213 supplied to the shift register 215 and the 1-bit data EC from the memory M2. Data E and EC are stored in the shift register 215 in groups of 4 bits in a parallel manner as shown in FIG. 6D in synchronization with the clock signal $\phi$S from the control circuit 212. The stored data E and EC in the shift register 215 is supplied to the select circuit 214 during the next horizontal scanning period. Based on the select signal SEL0 of FIG. 6E from the control circuit 212, the select circuit 214 selectively supplies data E during the first half interval ($\frac{1}{2}$H) and data EC for the second half ($\frac{1}{2}$H) to the signal electrode driving circuit 16. In response to the latch signal $\phi$n of FIG. 6J from the control circuit 12, the signal electrode driving circuit 16 latches data every $\frac{1}{2}$ horizontal scanning period, and then converts the latched data into the liquid crystal driving voltages VLC. It also inverts the voltages VLC in polarity to perform alternate-current driving based on the inversion signal $\phi$F. It then supplies the resulting signal to the signal electrodes of the liquid crystal display panel 217. The liquid crystal panel 217 is of the STN type with 240×528 dots.

The start signal ST2 from the control circuit 212, which goes high during one horizontal scanning period for each $\frac{1}{2}$ field as shown in FIG. 6G, is supplied to the shift registers 18 and 19, which then shift the signal successively in response to the clock signal $\phi$n (FIG. 6J). As a result, the shift registers 18 and 19 always supply an output signal with only one bit high to the output control circuits 222 and 223. Based on the output inhibit signals INH1 and INH2 of FIGS. 6H and 6I inverted in synchronism with the horizontal synchronizing signal $\phi$H (FIG. 6A), the output control circuits 222 and 223 alternately supply the signals from the shift registers 18 and 19 to the scanning electrode driving circuits 20 and 21 during each one horizontal scanning period. That is, they apply the signals X'1 through X'120 and X'121 through X'240 of FIGS. 6K and 6L to the corresponding scanning electrode driving circuits 20 and 21. The scanning electrode driving circuits 20 and 21 convert the signals X'1 through X'120 and X'121 through X'240 into the liquid crystal driving voltages VLC and then invert the voltages VLC in polarity in response to the inversion signal $\phi$F for the alternating-current driving of the liquid crystal display panel 217. The scanning electrode driving circuits 20 and 21 apply the resulting liquid crystal driving voltages VLC to the scanning electrodes X1 through X240 of the liquid crystal display panel 217 to drive them.

As described above, in the first half of each field, the driving voltages corresponding to the video data (E, EC) 1H, 121H (MSB), 2H, 122H (MSB), . . . are supplied to the signal electrodes of the liquid crystal display panel 217, while the scanning electrodes are selected in the order of X1, X121' X2' 122' . . . On the other hand, in the second half of each field, the video data (E, EC) 121H, 1H (MSB), 122H, 2H (MSB), . . . are supplied to the signal electrodes, whereas the scanning electrodes are selected in the order of X121, X1, X122, X2, . . . Since liquid crystal has storage effect, averaging of one field interval provides proper driving.

Figure 7:
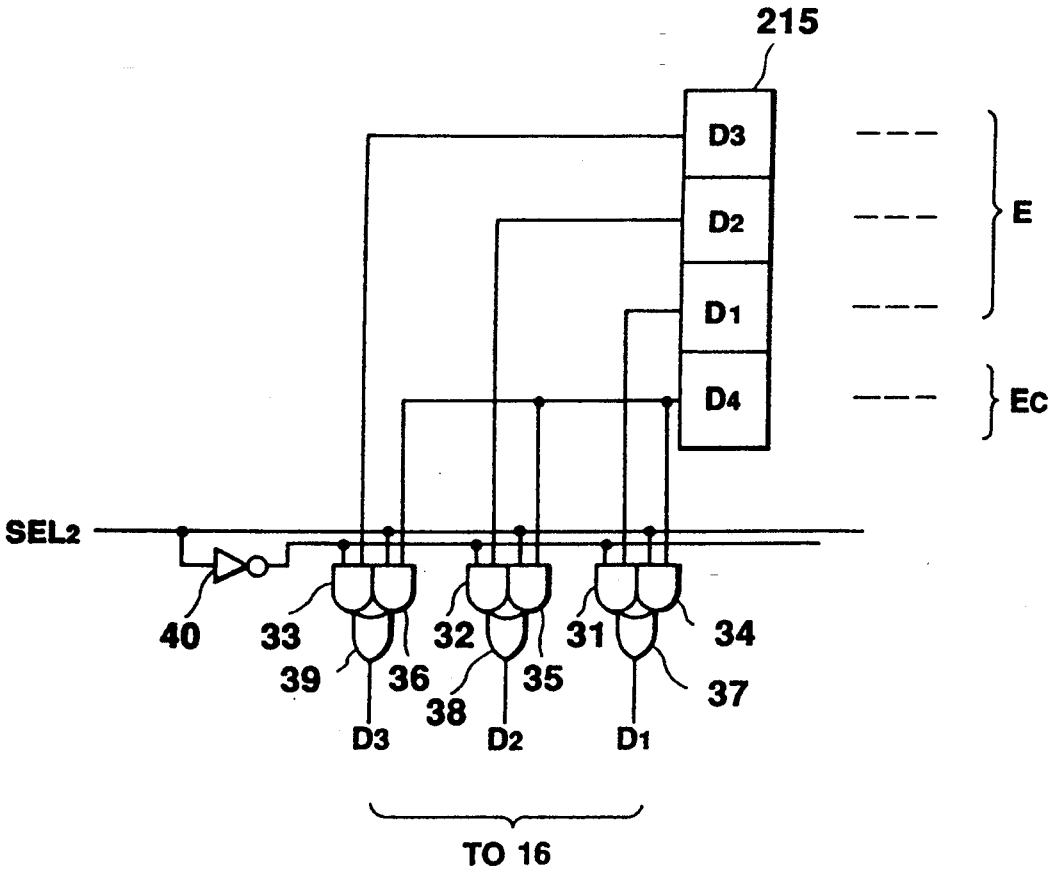
FIG. 7 is a detailed circuit diagram of the select circuit of FIG. 5.

FIG. 7 shows an example of the select circuit 214, which is made up of AND circuits 31 through 36, OR circuits 37 through 39, and an inverter 40. For the video data E and the memory data EC sorted in the 4bit (D1 through D4) shift register 215, D1 through D3 are supplied to the AND circuits 31 through 33 at one input terminal, respectively, while D4 is supplied to the AND circuits 34 through 36 at one input terminal. The other input terminal of each of the AND circuits 34 through 36 receives the select signal SEL2, while the other input terminal of each of the AND circuits 31 through 33 receives the select signal SEL2 via the inverter 40. The outputs of the AND circuits 31 and 34 are supplied to the input terminals of the OR circuit 37; the outputs of AND circuits 32 and 35 to the input terminals of the OR circuit 38; and the outputs of AND circuits 33 and 36 to the input terminals of the OR circuit 39. As a result, the OR circuits 37 through 39 supply the signal E or data D1 through D3 to the signal electrode driving circuit 16.

As described above, in this embodiment the signal electrodes are driven by alternately outputting the video data stored in the memory and the fresh video data bypassing the memory during every $\frac{1}{2}$ horizontal scanning period. At the same time, the common electrodes corresponding to the video data are driven. Thus, it is possible to provide a liquid crystal driving device with a smaller memory capacity that doubles the driving frequency without increasing the data transfer speed in the segment electrode driving circuit.

Figures 8A, 8B, 8C, 8D, 8E, 8F, 8G, 8H, 8I, 8J, 8K, 8L:
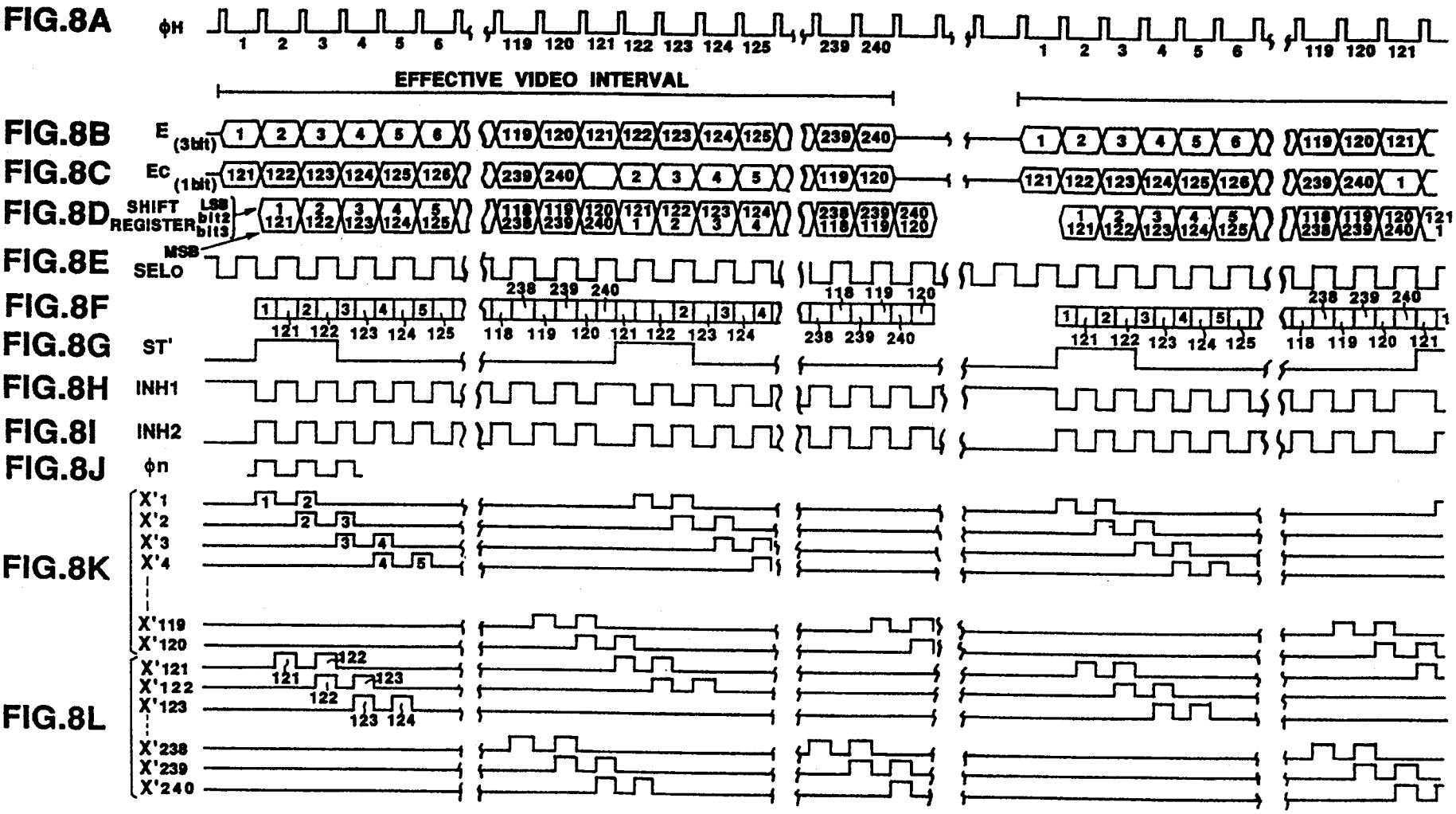
FIGS. 8A through 8L are time charts for describing a modification of the second embodiment.

FIG. 8 illustrates a modification of the second embodiment. Here, the start signal ST2 generated at the control circuit 212 is replaced with the signal ST' whose pulse width is two horizontal scanning periods as shown in FIG. 8G. With the signal ST', the output control circuits 222 and 223 supply the output signals X'1 through X'240 as shown in FIGS. 8K and 8L, thereby doubling the selection interval for each scanning line. This results in the lower duty cycle, the higher display margin, and the much higher contrast.

A third embodiment of the present invention will be explained hereinafter.

A liquid crystal display device according to the third embodiment comprises: a memory section with a capacity of a $\frac{1}{4}$ field ×1 bit for storing the video data containing at least the most significant bits of a series of video data every other horizontal scanning period; a select circuit for periodically selecting the video data containing at least the most significant bits stored in the memory section and the video data bypassing the memory section and then alternately outputting them; a signal electrode driving circuit for driving the segment electrodes according to the data from the select circuit; and a scanning electrode driving circuit for driving the scanning electrodes corresponding to the video data from the select circuit in groups of multiple electrodes. In this arrangement, the signal electrodes are driven by being alternately supplied with the video data stored in the memory section and the fresh data bypassing the memory section. At the same time, the scanning electrodes corresponding to the video data are driven in groups of two.

Referring to the drawings, the third embodiment of the present invention will now be described in detail.

Figure 9:
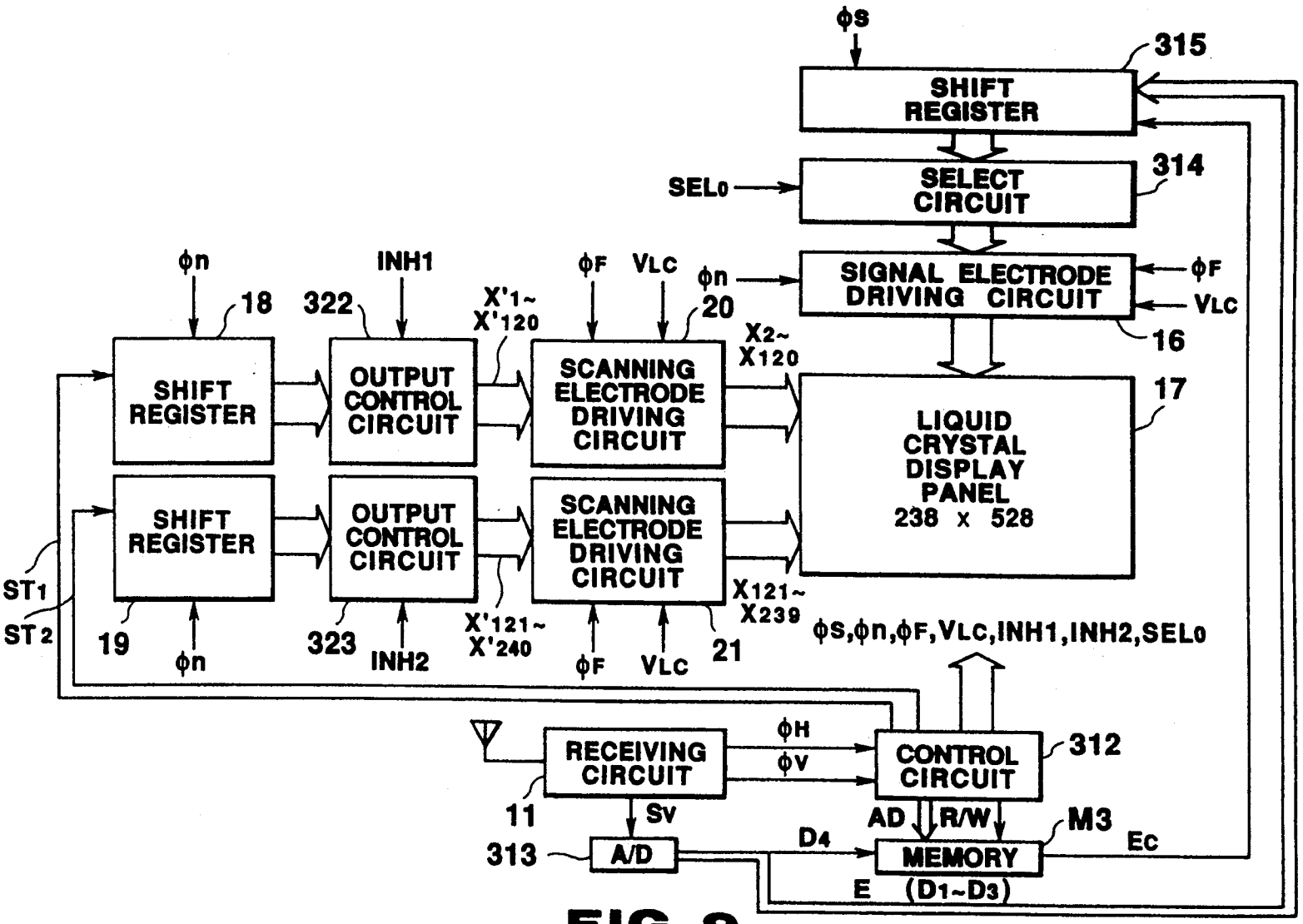
FIG. 9 is a block diagram for a third embodiment of the present invention.

FIG. 9 is a block diagram for a liquid crystal driving device according to the third embodiment and FIGS. 10A through 10M are timing charts for illustrating the operation of the liquid crystal driving device of FIG. 9 together with the contents of data.

Figures 10A, 10B, 10C, 10D, 10E, 10F, 10G, 10H, 10I, 10J, 10K, 10L, 10M:
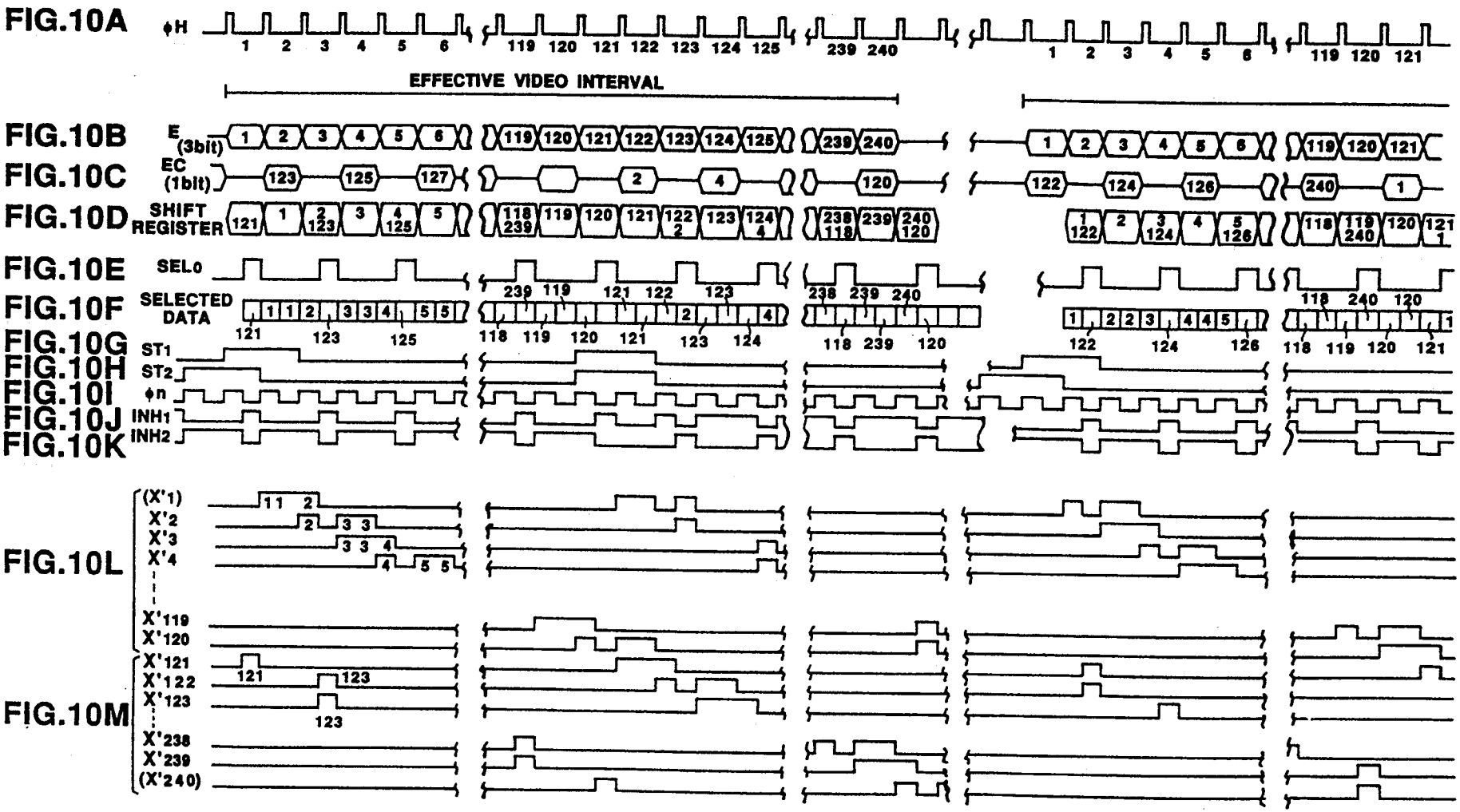
FIGS. 10A through 10M are time charts for explaining the operation of the third embodiment.

The receiving circuit 11 extracts from the received television signal the video signal SV, the horizontal synchronizing signal $\phi$H of FIG. 10A and the vertical synchronizing signal $\phi$V, and then supplies the video signal SV to the A/D converter 313 and the horizontal synchronizing signal $\phi$H (FIG. 10A) and vertical synchronizing signal $\phi V$ to the control circuit 312. Based on the horizontal synchronizing signal $\phi H$ (FIG. 10A) and the vertical synchronizing signal $\phi V$, the control circuit 312 produces various timing signals including: the start signals ST1 and ST2 of FIGS. 10G and 10H, the clock signal $\phi s$, the latch signal $\phi n$ of FIG. 10I, the inversion signal $\phi F$, the output inhibit signals INH1 and INH2 of FIGS. 10J and 10K, the select signal SEL0 of FIG. 10E, the address signal AD, and the read/write signal R/W. It then supplies these timing signals to the appropriate circuits including: the shift registers 315, 18, and 19, the driving circuits 16, 20, and 21, the select circuit 314, the memory M3, the output control circuits 322 and 323. It also generates a plurality of liquid crystal driving voltages VLC to supply them to the driving circuit 16, 20, and 21.

The A/D converter 313 converts the received video signal SV into k-bit video data, for example, 4bit digital video data (D1 through D4). Based on the address signal AD and the read/write signal R/W from the control circuit 212, the memory M3 reads the most significant bit (D4) of the video data every other horizontal scanning period. The lower three bits (D1 through D3) of the video data from the A/D converter 313 are supplied to the shift register 315.

As shown in FIG. 10C, after half a field period elapses from storing, a $\frac{1}{2}$ field of data stored in the memory M3 is read on the basis of the address signal AD and read/write signal R/W from the control circuit 312 and then supplied as a one-bit data EC to the shift register 315. The 3-bit video data E from the A/D converter 313 and the 1-bit EC from the memory M3 are stored and shifted in the shift register 315 whose bit width is 4 bits, in synchronization with the clock signal $\phi S$ from the control circuit 312. FIGS. 10B and 10C show the timing relationship between data E and EC. The stored data E and EC in the shift register 315 is supplied to the select circuit 314 during the next horizontal scanning period H. The interrelation between the output data from the shift register 315 is shown in FIG. 10D. Based on the select signal SEL0 of FIG. 10E, the select circuit 314 selects data E during three $\frac{1}{2}$ horizontal scanning periods and data EC during a $\frac{1}{2}$ horizontal scanning period as shown in FIG. 10F and then supplies them alternately to the signal electrode driving circuit 16. The construction of the select circuit 314 is the same as in FIG. 7. In response to the latch signal $\phi n$ of FIG. 10I from the control circuit 312, the signal electrode driving circuit 16 latches data E and EC every $\frac{1}{2}$ horizontal scanning period and then converts them into the liquid crystal driving voltages VLC. It inverts the converted voltages VLC in polarity based on the inversion signal $\phi F$ and then applies them to the signal electrodes.

The start signals ST1 and ST2 from the control circuit 312, whose pulse width is two horizontal scanning periods as shown in FIGS. 10G and 10H, are supplied to the shift registers 18 and 19, and then shifted successively every horizontal scanning period in response to the clock signal $\phi n$. As a result, each output signal from the shift registers 18 and 19 has two consecutive high bits. Based on the output inhibit signals INH1 and INH2 of FIGS. 10J and 10K inverted every horizontal scanning period in synchronism with the horizontal synchronizing signal $\phi H$, the output control circuits 322 and 323 alternately supply the output signal from the shift registers 18 and 19 to the scanning electrode driving circuits 20 and 21 every horizontal scanning period. That is, the output signals from the output control circuits 322 and 323 are the signals X'1 through X'120 and X'121 through X'240 as shown in FIGS. 10L and 10M. As with the first embodiment, X'1 and X'240 are not used in actual display. Using the signals X'1 through X'120 and X'121 through X'240' the inversion signal $\phi F$, and the liquid crystal driving voltages VCL, the scanning electrode driving circuits 20 and 21 produce the driving signals and then apply them to the scanning electrodes X2 through X120 and X121 through X239 of the liquid crystal display panel 17 to drive the scanning electrodes in groups of two.

The driving voltages VLC corresponding to data 121H (MSB), 1H, 1H, 2H, 123H (MSB), 3H, 3H, 4H, . . . are supplied to the signal electrodes of the liquid crystal display panel 17, while the scanning electrodes X121, X1, X1, X1, and X2, X122, and X123, X2, and X3, X2, and X3, X3, and X4, . . . are selected. Since liquid crystal has storage effect, proper driving is achieved for one field as a whole.

As described above, with the liquid crystal display device according to this embodiment, the segment electrodes are driven by alternatively selecting the video data stored in a memory with a capacity of a $\frac{1}{4}$ field $\times 1$ bit during $\frac{1}{2}$ horizontal scanning period and the fresh video data bypassing the memory during $3 \times \frac{1}{2}$ horizontal scanning periods and then supplying the selected signal to the signal electrodes. At the same time, the scanning electrodes corresponding to the video data are driven in groups of two. Therefore, it is possible to provide a liquid crystal display device with a smaller memory capacity which doubles the driving frequency without increasing the data transfer speed of the signal electrode driving circuit.

A fourth embodiment of the present invention will be explained hereinafter.

A liquid crystal display device according to the fourth embodiment comprises: a memory section for storing the video data containing at least the most significant bits of a series of video data; a select circuit for alternately selecting and outputting, every horizontal scanning period, the video data supplied from the memory section and the video data consisting of the video data bypassing the memory section rearranged in a specified order; a signal electrode driving circuit for driving the signal electrodes according to the data from the select circuit; and a scanning electrode driving circuit for driving the scanning electrodes corresponding to the video data from the select circuit in groups of multiple electrodes. In this arrangement, the signals corresponding to the data stored in the memory section and the video data consisting of the fresh video data whose bits are alternately supplied to the signal electrodes, each of the signals are supplied during one horizontal scanning period. At the same time, the scanning electrodes are driven in groups of two.

Referring to the drawings, the fourth embodiment of the present invention will be described in detail.

Figure 11:
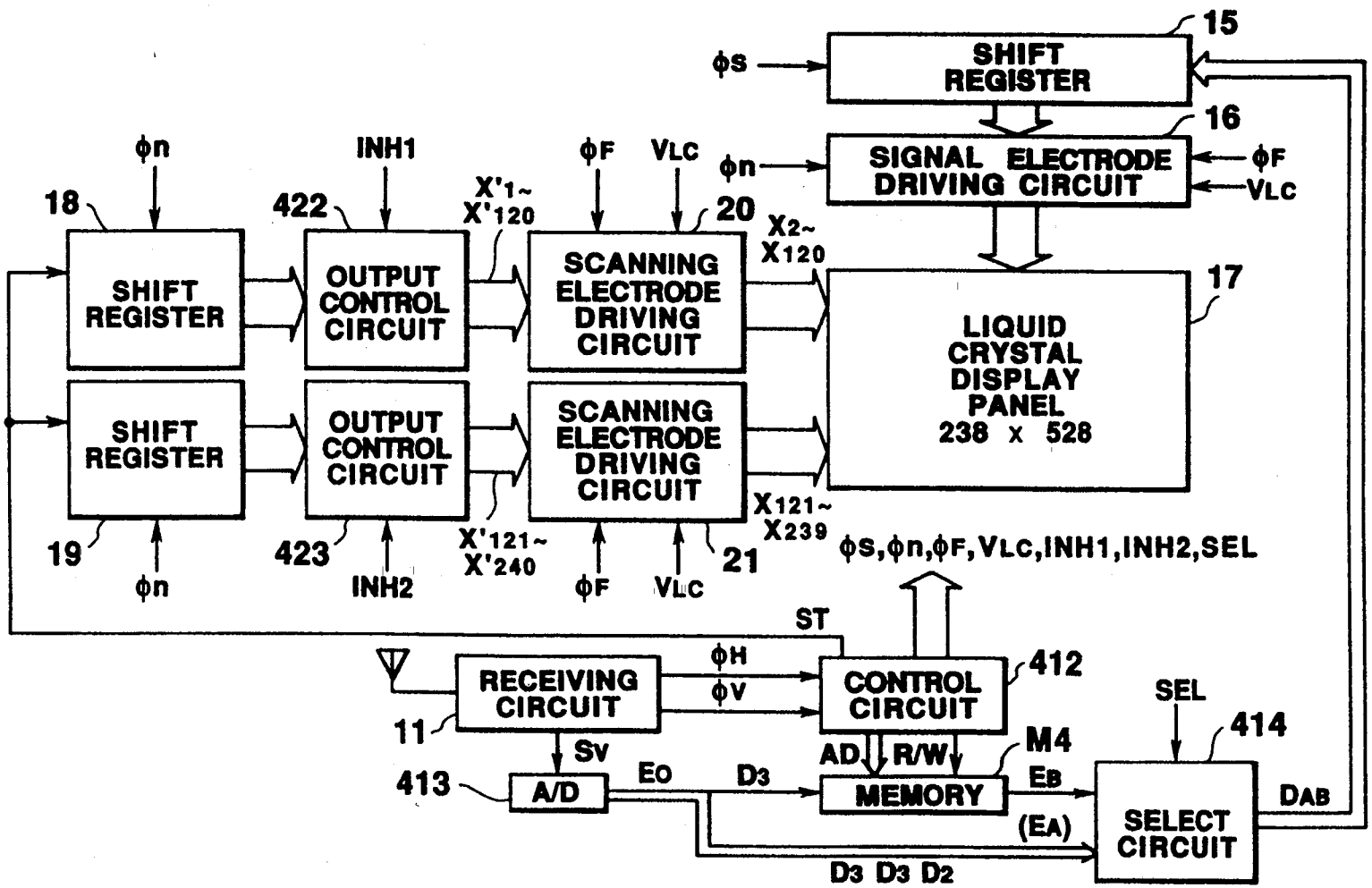
FIG. 11 is a block diagram for a fourth embodiment of the present invention.

FIG. 11 is a block diagram for a liquid crystal driving device according to this embodiment and FIGS. 12A through 12J are timing charts for illustrating the operation of the liquid crystal display device of FIG. 11 along with the contents of data.

The receiving circuit 11 extracts from the received television signal the video signal SV, the horizontal synchronizing signal $\phi H$ of FIG. 12A and the vertical synchronizing signal $\phi V$, and then supplies the video signal SV to the A/D converter 413 and the horizontal synchronizing signal $\phi H$ (FIG. 12A) and vertical synchronizing signal $\phi V$ to the control circuit 412. Based on the horizontal synchronizing signal $\phi H$ (FIG. 12A) and the vertical synchronizing signal $\phi V$, the control circuit 412 produces various timing signals including: the start signal ST of FIGS. 12F, the clock signal $\phi s$, the latch signal $\phi n$, the inversion signal $\phi F$, the output inhibit signals INH1 and INH2 of FIGS. 12G and 12H, the select signal SEL of FIG. 12D, the address signal AD, and the read/write signal R/W. It then supplies these timing signals to the appropriate circuits including: the shift registers 15, 18, and 19, the driving circuits 16, 20, and 21, the select circuit 14, the memory M4, and the output control circuits 422 and 423. It also generate a plurality of liquid crystal driving voltages VLC to supply them to the driving circuits 16, 20, and 21.

Figures 13, 14:
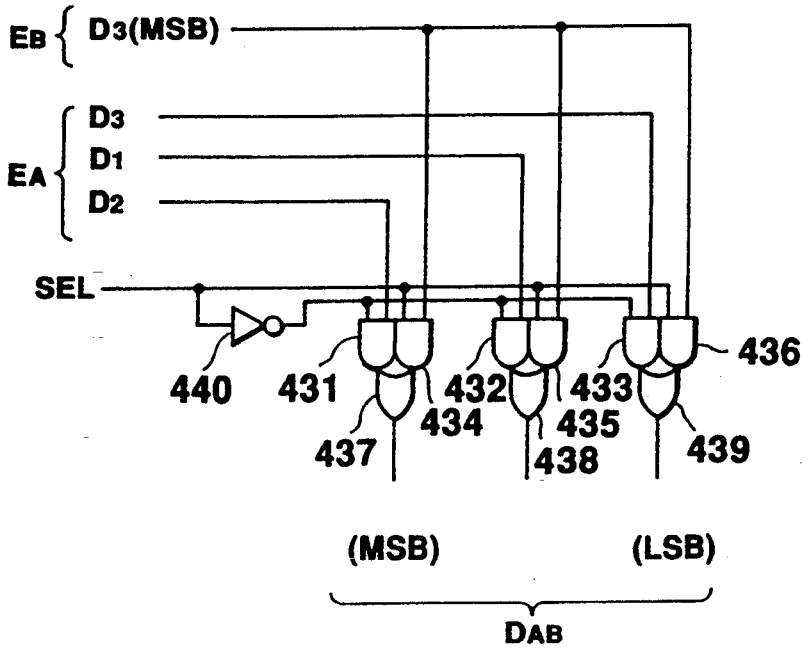
FIG. 13 is a detailed circuit diagram of the select circuit of FIG. 11.
FIG. 14 shows the relationship between display data and gradation in the fourth embodiment.

The A/D converter 413 converts the received video signal SV into k-bit video data, for example, 3-bit video data E0 (D3, D2, D1, in descending order) as shown in FIG. 14, and then supplies it to the memory M4. The memory M4 reads the most significant bit (D3) of the video data E0 according to the address signal AD and the read/write signal R/W from the control circuit 412.

The period corresponding to half a field later, a ½ field of data stored in the memory M4 is read every other 1H on the basis of the address signal AD and read/write signal R/W from the control circuit 412, and then supplied to the select circuit 414 as a 3-bit video data EB (D3, D3, D3) consisting of the most significant bits as shown in FIG. 14.

The 3-bit video data E0 (D3, D2, D1, in descending order) from the A/D converter 413 are rearranged into (D2, D1, D3, in descending order) so as to provide proper gradation display, and then is supplied as the video data EA to the select circuit 414. FIGS. 12B and 12C show the output timing relationship between video data EA and EB. Here, n−1, n, n+1 indicate the numbers of the vertical scanning periods and 1 through 240 represent the numbers of the horizontal scanning periods. Based on the select signal SEL (FIG. 12D) from the control circuit 412, the select circuit 414 alternately selects the video data EA and the video data EB during one horizontal scanning period as shown in FIG. 12E to supply it to the shift register 15 as data DAB. The data DAB is stored in the shift register 15 in synchronization with the clock signal $\phi S$ from the control circuit 412. The signal electrode driving circuit 16 latches the data DAB stored in the shift register 15 every one horizontal scanning period on the basis of the latch signal $\phi n$ from the control circuit 412. Using the inversion signal $\phi F$ and the liquid crystal driving voltages VLC, it also generates alternating-current driving signals to supply them to the signal electrodes.

Figures 12I, 12J:
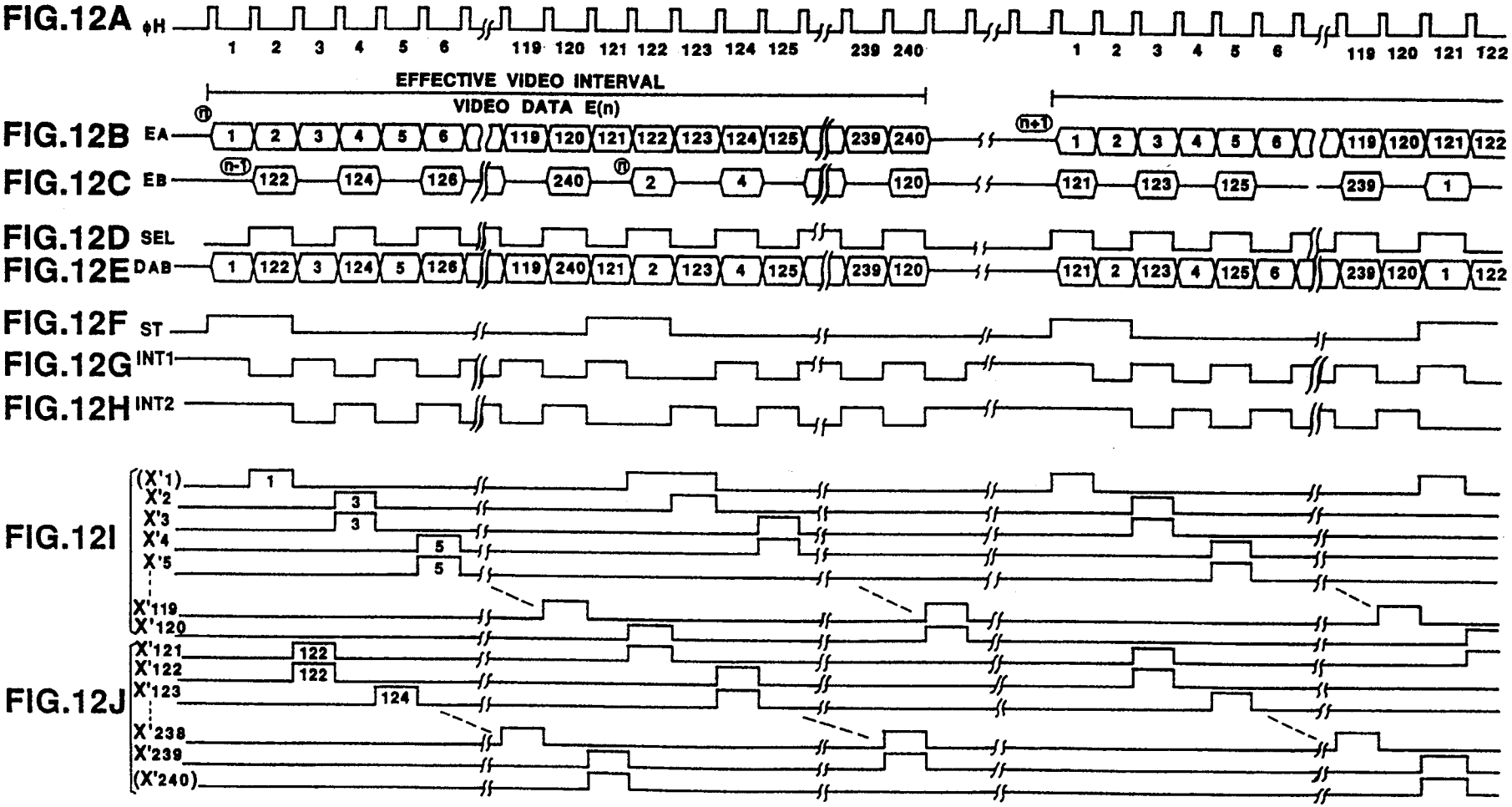

The start signal ST of FIG. 12F from the control circuit 412, whose pulse width is 2 horizontal scanning periods, is supplied to the shift registers 18 and 19, and then shifted successively for every elapse of one horizontal scanning period in response to the clock signal $\phi n$. As a result, each output signal from the shift registers 18 and 19 is supplied to the output control circuits 422 and 423 so that the scanning electrode driving circuits 20 and 21 may drive the scanning electrodes in groups of two. On the other hand, based on the output inhibit signals INH1 and INH2 of FIGS. 12G and 12H inverted every one horizontal scanning period in synchronism with the horizontal synchronizing signal $\phi H$, the output control circuits 422 and 423 alternately supply the output signal from the shift registers 18 and 19 to the corresponding scanning electrode driving circuits 20 and 21 during one horizontal scanning period. Therefore, the output signals from the output control circuits 422 and 423 are the signals X'1 through X'120 and X'121 through X'240 in FIGS. 12I and 12H. Using the signals X'1 through X'120 and X'121 through X'240' the inversion signal $\phi F$, and the liquid crystal driving voltages VLC, the common electrode driving circuits 20 and 21 alternately drive the scanning electrodes X2 through X120 and X121 through X239 in groups of two.

In this embodiment, the signals corresponding to data EA (D2, D1, D3, in descending order) and data EB (D3, D3, D3, in descending order) as shown in FIG. 14 are alternately supplied to the liquid crystal display panel 17. Since liquid crystal has storage effect, proper gradation is accomplished for the display gradation (EA+EB)/2 of the liquid crystal display panel 17.

FIG. 13 shows an example of the select circuit 414, which is composed of AND circuits 431 through 436, OR circuits 437 through 439, and an inverter 440. Data EA (D2, D1, D3' in descending order) as shown in FIG. 14 are supplied to the AND circuits 431 through 433 at one input terminal, respectively, while data EB (the most significant bit D3) is supplied to the AND circuits 434 through 436 at one input terminal. The other input terminal of each of the AND circuits 434 through 436 receives the select signal SEL, while the other input terminal of each of the AND circuits 431 through 433 receives the select signal SEL via the inverter 440. The outputs of the AND circuits 431 and 434 are supplied to the input terminals of the OR circuit 437; the outputs of AND circuits 432 and 435 to the input terminals of the OR circuit 438; and the outputs of AND circuits 433 and 436 to the input terminals of the OR circuit 439. As a result, the data DAB appears at the output terminals of the OR circuits 437 through 439.

As described above, in this embodiment, the signal electrodes are driven by alternately supplying the most significant bit video data stored in the memory section and the video data consisting of the fresh video data bypassing the memory whose bits are rearranged suitably. At the same time, the common electrodes corresponding to the video data are driven in groups of two. Therefore, it is possible to provide a liquid crystal display device with a smaller memory capacity that doubles the driving frequency without increasing the data transfer speed of the segment electrode driving circuit and provides proper gradation display.

A fifth embodiment of the present invention will be explained hereinafter.

A liquid crystal display device according to the fifth embodiment comprises: a memory section for storing the video signal containing at least the most significant bits of a series of video data; an adder section for adding the least significant bit to the data consisting of a plurality of the upper bits of the video data bypassing the memory section rearranged in a specified order; a select section for alternately outputting the video data added at the adder section and the video data containing at least the most significant bit supplied from the memory section every other horizontal scanning period; a signal electrode driving circuit for driving the signal electrodes according to the data from the select section; and a scanning electrode driving circuit for driving the scanning electrodes corresponding to the video data from the select section in groups of multiple electrodes. In this arrangement, the signal electrodes are alternately driven by the video data containing the most significant bit of the video data stored in the memory section and the video data consisting of a plurality of the upper bits of the fresh video data bypassing the memory rearranged so as to provide proper gradation display and then added to the least significant bit. Either video data is supplied to the signal electrodes during one horizontal scanning period. At the same time, the scanning electrodes corresponding to the video data are driven in groups of two.

Referring to the drawings, the fifth embodiment of the present invention will be described in detail.

Figure 15:
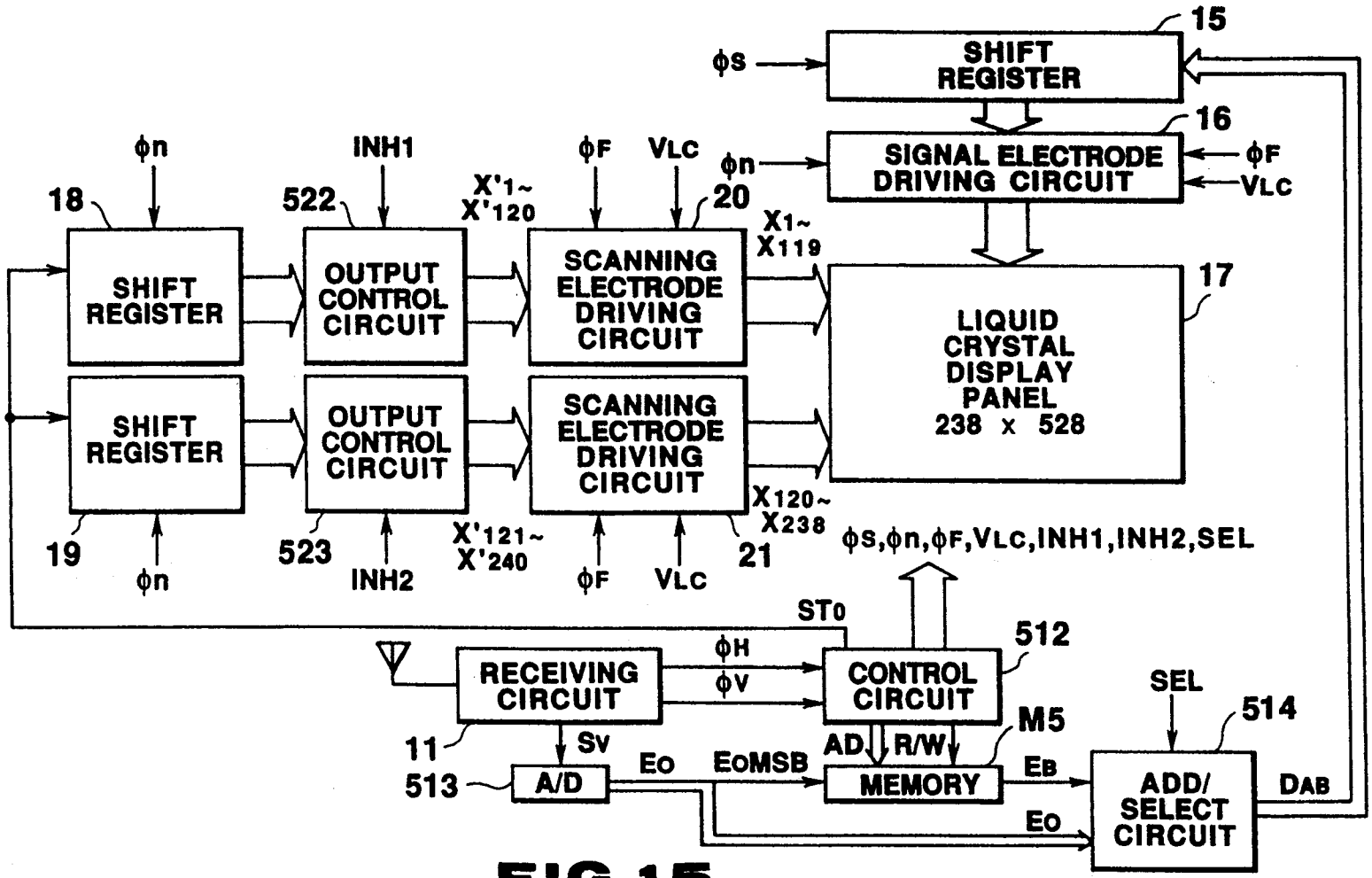
FIG. 15 is a block diagram for a fifth embodiment of the present invention.

FIG. 15 is a block diagram for a liquid crystal display device according to this embodiment and FIGS. 16A through 16J are timing charts for illustrating the operation of the liquid crystal driving device of FIG. 15 together with the contents of data.

The receiving circuit 11 extracts from the received television signal the video signal SV' the horizontal synchronizing signal $\phi$H (FIG. 16A) and the vertical synchronizing signal $\phi$V, and then supplies the video signal SV to the A/D converter 513 and the horizontal synchronizing signal $\phi$H (FIG. 16A) and vertical synchronizing signal $\phi$V to the control circuit 512. Based on the horizontal synchronizing signal $\phi$H (FIG. 16A) and the vertical synchronizing signal $\phi$V, the control circuit 512 produces various timing signals including: the start signal STO (FIG. 16F), the clock signal $\phi$s, the latch signal $\phi$n, the inversion signal $\phi$F, the output inhibit signals INH1 and INH2 (FIGS. 16G and 16H), the select signal SEL (FIG. 16D), the address signal AD, and the read/write signal R/W. It then supplies these timing signals to the appropriate circuits including: the shift registers 15, 18, and 19, the driving circuits 16, 20, and 21, the add/select circuit 514, the memory M5, the output control circuits 522 and 523. It also generates a plurality of liquid crystal driving voltages VLC to supply them to the driving circuits 16, 20, and 21.

Figures 17, 18:
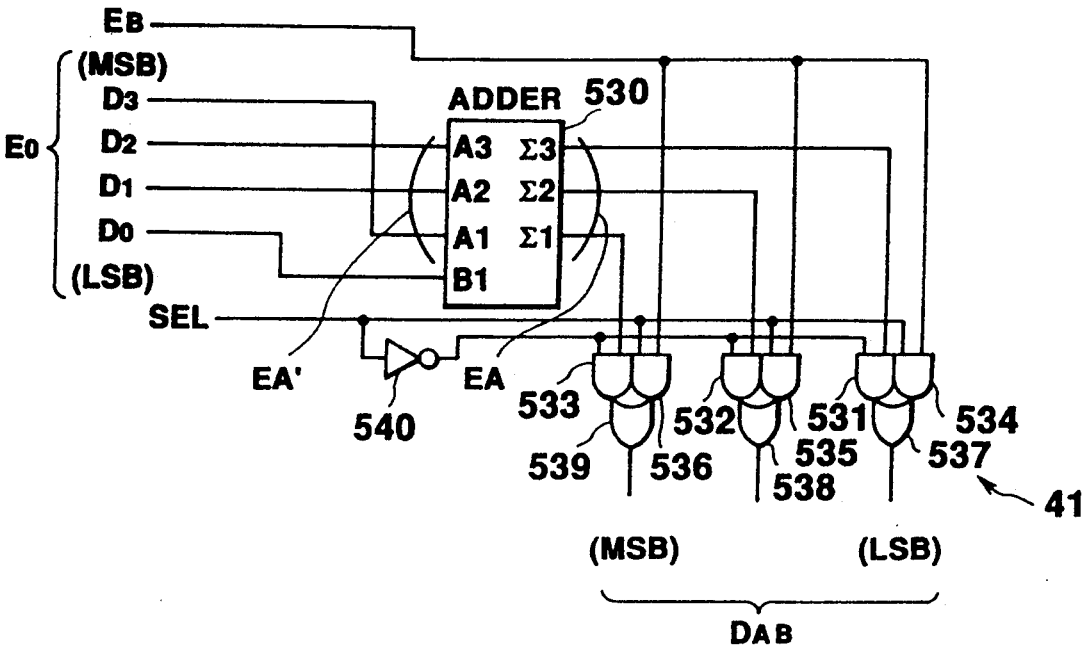
FIG. 17 is a detailed circuit diagram of the select circuit of FIG. 15.
FIG. 18 shows the relationship between display data and gradation in the fifth embodiment.

The A/D converter 513 converts the received video signal SV into k-bit video data E0, for example, 4bit video data (D3, D2, D1, D0, in descending order) as shown in FIG. 18, and then supplies it to the memory M5. The memory M5 reads the most significant bit (D3) of the video data E0 according to the address signal AD and the read/write signal R/W from the control circuit 512.

After a period corresponding to half a field elapses, a ½ field of data stored in the memory M5 is read every other one horizontal scanning period on the basis of the address signal AD and read/write signal R/W from the control circuit 512, and then supplied to the add/select circuit 514 as a 3-bit video data EB (D3, D3, D3=b, in descending order) consisting of the most significant bits as shown in FIG. 18. FIG. 16C shows the output timing for the video data EB.

The 4bit video data E0 (D3, D2, D1, D0, in descending order) from the A/D converter 513 is supplied to the add/select circuit 514. As shown in FIG. 17, the add/select circuit 514 is composed of an adder 530 and a select circuit 541 consisting of AND circuits 531 through 536, OR circuits 537 through 539, and an inverter 540. The adder 530 receives the least significant bit D0 and the data EA' of 3 bits (D2, D1, D3=a, in descending order) of FIG. 18, which is obtained by rearranging the upper 3 bits of the video data E0 (D3, D2, D1, D0, in descending order) to provide proper gradation display. It then adds the input data EA' and D0 and at the timing shown in FIG. 16B, supplies the result to the select circuit 541 as an added video data EA (a'=(D2, D1, D3)+D0). Based on the select signal SEL (FIG. 16D) from the control circuit 512, the select circuit 514 alternately outputs the added video data EA and the video data EB (D3, D3, D3) from the memory M5 as the data DAB of FIG. 16E during every horizontal scanning period. The data DAB is stored in the shift register 15 in synchronization with the clock signal $\phi$S from the control circuit 512. The signal electrode driving circuit 16 latches the data EAB stored in the shift register 15 during every horizontal scanning period on the basis of the latch signal $\phi$n from the control circuit 512. Using the latched data DAB for one horizontal scanning period, the inversion signal $\phi$F, and the liquid crystal driving voltages VLC, the driving circuit 16 alternately drives the signal electrodes.

Figures 16I, 16J:
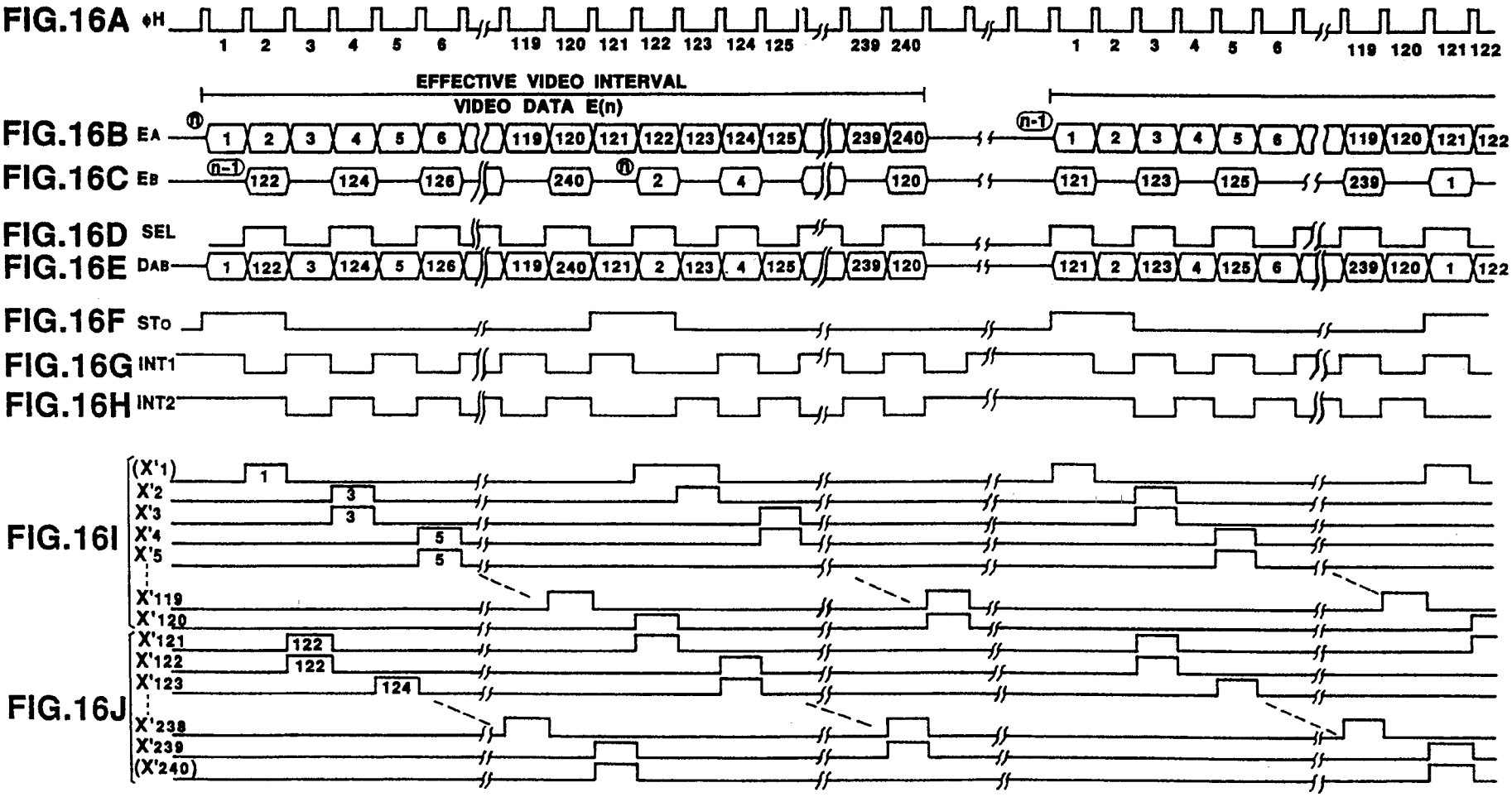

The start signal ST0 with a period of a ½ frame and a pulse width of two horizontal scanning periods as shown in FIG. 16F is supplied to the shift registers 18 and 19, and then shifted for every elapse of one horizontal scanning period in response to the clock signal $\phi$n. As a result, each output signal from the shift registers 18 and 19 is supplied to the output control circuits 522 and 523 so that the scanning electrode driving circuits 20 and 21 may drive the scanning electrodes in groups of two. Based on the output inhibit signals INH1 and INH2 (FIGS. 16G and 16H) inverted every one horizontal scanning period in synchronism with the horizontal synchronizing signal $\phi$H, the output control circuits 522 and 523 alternately supply the output signal from the shift registers 18 and 19 to the corresponding scanning electrode driving circuits 20 and 21. Either output signal from the register 18 and 19 is supplied to them during one horizontal scanning period. FIGS. 16I and 16J show the output signals from the output control circuits 522 and 523. Using the signals X'1 through X'120 and X'121 through X'240, the inversion signal $\phi$F, and the liquid crystal driving voltages VLC, the scanning electrode driving circuits 20 and 21 alternately drive the scanning electrodes X1 through X119 and X120 through X238 in groups of two.

The liquid crystal display panel 17 is alternately driven by the video data EA ((D2, D1, D3)+DO=a') and the video data EB of the most significant bits (D3, D3, D3=b), which causes the display gradation to be a'+b, which is almost equal to the display gradation specified by the original video data E0.

FIG. 17 shows an example of the add/select circuit 514, which is composed of an adder 530, AND circuits 531 through 536, OR circuits 537 through 539, and an inverter 540. The upper 3 bits (D3, D2, D1)of the video data E0 are rearranged and supplied as data EA' to the input terminals A3, A2, and A1 of the adder 530. The least significant bit D0 of the video data E0 is supplied to the input terminal B of the adder 530. As a result, the 3-bit data EA' and the least significant bit D0-added data EA as shown in FIG. 18 appear at the output terminals E3, E2, and E1 of the adder 530. The data EA is supplied to the AND circuits 534 through 536 at one input terminal, while the most significant bit D3 of the video data E0 is supplied to the AND circuits 534 through 536 at one input terminal. The other input terminal of each of the AND circuits 534 through 536 receives the select signal SEL of FIG. 16D, while the other input terminal of each of the AND circuits 531 through 533 receives the select signal SEL via the inverter 540. The outputs of the AND circuits 531 and 534 are supplied to the input terminals of the OR circuit 537, whereas the outputs of the AND circuits 532 and 535 are supplied to the input terminals of the OR circuit 538. Further, the outputs of AND circuits 533 and 536 are supplied to the input terminals of the OR circuit 539. As a result, the OR circuits 537 through 539 have the data DAB at their output terminals to supply them to the shift register 15.

As described above, in this embodiment, the segment electrodes are alternately driven by the data consisting of a plurality of the most significant bits of the video data stored in the memory section and the video data consisting of the upper 3 bits of the fresh video data suitably arranged and then added to the least significant bit. At the same time, the scanning electrodes are driven in groups of two. Therefore, it is possible to provide a liquid crystal display device with a smaller memory capacity that doubles the driving frequency without increasing the data transfer speed of the signal electrode driving circuit and achieves almost proper gradation display.

Although in the above embodiments, the STN-type liquid crystal is used, this invention is not restricted to this and may be applied to other display elements including the TN-type liquid crystal. Naturally, this invention may be applicable to the active matrix liquid crystal display device.

A horizontal division type liquid crystal panel, whose signal electrodes are divided into an upper half and a lower half at the center, may be used. Use of this type of liquid crystal panel helps alleviate the duty, cycle which cooperates with the effects of the present invention to raise the contrast even further.

While in the foregoing embodiments, the present invention is applied to an liquid crystal television, it is not restricted to this, and may be applied to other devices such as personal computers, word processors, projectors, or view finders.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A liquid crystal display device, comprising:

liquid crystal display panel means for displaying images, said liquid crystal display panel means having a plurality of scanning electrodes and a plurality of signal electrodes, and said liquid crystal display device being divided into at least first and second display portions, said signal electrodes being used in common to the first and second display portions;

a video signal source for generating a video signal;

memory means for storing at least part of the video signal;

scanning means for scanning a plurality of frames of each of the first and second display portions of the liquid crystal display panel such that during a one-frame interval of the video signal, comprising an odd-numbered field and an even-numbered field, a plurality of scanning electrodes of the first display portion are simultaneously selected, and subsequently a plurality of scanning electrodes in the second display portion are simultaneously selected such that a plurality of scanning electrodes in each of the first and second display portions are alternately selected; and video signal control means for performing control such that, at the time of the odd numbered field of the video signal, the video signal generated by the video signal source is displayed on the first display portion of the liquid crystal display panel means and the video signal stored in the memory means is displayed on the second display portion of the liquid crystal display panel means, and such that, at the time of the even-numbered field of the video signal, the video signal generated by the video signal source is displayed on the second display portion of the liquid crystal display panel means and the video signal stored in the memory means is displayed on the first display portion of the liquid crystal display panel means.

2. A liquid crystal display device according to claim 1, wherein said scanning means selects a given scanning electrode a number of times during one frame of the video signal.

3. A liquid crystal display device according to claim 2, wherein said given scanning electrode is not selected successively.

4. A liquid crystal display device according to claim 1, wherein said memory means stores the video signal during every other horizontal interval.

5. A liquid crystal display device according to claim 1, wherein said first and second display portions are lower and upper display portions, respectively.

6. A liquid crystal display device comprising;

a liquid crystal display panel having a plurality of scanning electrodes and a plurality of signal electrodes, said scanning electrodes being arranged in at least first and second groups of the scanning electrodes, said signal electrodes being used in common with the scanning electrodes of the first and second groups;

a video signal source for generating a video signal having odd and even fields;

memory means for storing at least part of the video signal;

scanning means for scanning a plurality of times each of the scanning electrodes of the first and second groups during a one-frame interval of the video signal, comprising the odd and even fields, a plurality of scanning electrodes of the first group are simultaneously selected, and subsequently a plurality of scanning electrodes in the second group are simultaneously selected such that a plurality of scanning electrodes in each of the first and second groups are alternatively selected; and video signal control means for performing control such that at the time of the odd field of the video signal, the video signal generated by said video signal source is supplied to the signal electrodes when the scanning electrodes of the first group are scanned and the video signal stored in said memory means is supplied to the signal electrodes when the scanning electrodes of the second group are scanned, and at the time of the even field of the video signal, the video signal generated by said video signal source is supplied to the signal electrodes when the scanning electrodes of the second group are scanned and the video signal stored in said memory means is supplied to the signal electrodes when the scanning electrodes of the first group are scanned.

* * * * *